US010119427B1

(12) United States Patent
Svegliato

(10) Patent No.: US 10,119,427 B1
(45) Date of Patent: Nov. 6, 2018

(54) OVERHEAD CAMSHAFT VALVETRAIN SYSTEM AND KIT FOR AN ENGINE

(71) Applicant: Daniel J. Svegliato, Long Beach, CA (US)

(72) Inventor: Daniel J. Svegliato, Long Beach, CA (US)

( * ) Notice: Subject to any disclaimer, the term of this patent is extended or adjusted under 35 U.S.C. 154(b) by 31 days.

(21) Appl. No.: 14/608,092

(22) Filed: Jan. 28, 2015

Related U.S. Application Data

(60) Provisional application No. 61/965,372, filed on Jan. 29, 2014.

(51) Int. Cl.
*F01M 1/06* (2006.01)
*F01L 1/053* (2006.01)
*F01L 1/26* (2006.01)

(52) U.S. Cl.
CPC ..... *F01L 1/053* (2013.01); *F01L 1/26* (2013.01)

(58) Field of Classification Search
CPC ..... F01L 1/053; F01L 1/26
See application file for complete search history.

(56) References Cited

U.S. PATENT DOCUMENTS 2,212,348 A * 8/1940 Ludington ..... F16H 35/02 123/51 AA
4,887,562 A * 12/1989 Wakeman ..... F01L 1/053 123/90.12
5,007,387 A * 4/1991 Arao ..... F01L 1/26 123/310
6,332,440 B1 * 12/2001 Nagai ..... F01L 1/02 123/196 R

* cited by examiner

*Primary Examiner* — Zelalem Eshete
(74) *Attorney, Agent, or Firm* — Knobbe Martens Olson & Bear LLP

(57) ABSTRACT

An overhead camshaft valvetrain system for use with components of an existing engine, such as a stock block, an intake manifold and an exhaust manifold. The overhead camshaft valvetrain system can be used to convert an existing engine having a cam-in-block design to an overhead camshaft design. The overhead camshaft valvetrain system can include a transmission system, a cylinder head having an overhead camshaft and overhead valves, and an oiling system.

23 Claims, 26 Drawing Sheets

OVERHEAD CAMSHAFT VALVETRAIN SYSTEM AND KIT FOR AN ENGINE

RELATED APPLICATIONS

This application claims the benefit of U.S. Provisional Application No. 61/965,372, filed Jan. 29, 2014, the contents of which are hereby incorporated by reference in their entirety as if fully set forth herein.

BACKGROUND

Field

Embodiments or arrangements disclosed herein relate to an overhead camshaft valvetrain system for use with an existing engine originally having a different valvetrain system and, more specifically, to a valvetrain kit for an existing engine which converts the existing engine's cam-in-block valvetrain system to an overhead cam valvetrain system.

Background

The valvetrain system of an engine plays a significant role in the performance of an engine. In many current commercial engines, the valvetrain system includes one or more camshafts, one or more intake valves and one or more exhaust valves. The camshafts are generally configured to control the timing and movement of the valves. The intake valves control the ingress of combustion reactants, such as air and/or fuel, into the combustion chamber and exhaust valves control the egress of combustion products, such as $H_2O$, CO, $CO_2$, $NO_x$, and unburned hydrocarbons out of the combustion chamber. The intake valves and exhaust valves are generally timed in accordance with movement of the piston. Generally, in a four-stroke engine having an intake stroke, a compression stroke, a power stroke and an exhaust stroke, the intake valves open during the intake stroke and close during the compression stroke and the exhaust valves open during the exhaust stroke and close during the intake stroke. The timing and movement of the intake valve and exhaust valve can play a significant role in the overall performance of an engine, such as the volumetric efficiency and maximum engine speed. Accordingly, many engines can benefit from an improved valvetrain system.

SUMMARY

Embodiments of the present disclosure relate to an overhead camshaft valvetrain system for use with an existing engine. In some embodiments described herein, the systems and methods described can be retrofitted onto an existing cam-in-block engine. That is, in some embodiments, the components of the systems described herein can be attached to existing engine components without modifying the existing engine components.

In some embodiments, an overhead camshaft valvetrain system can be used with an existing cam-in-block engine, the existing engine having at least a block and an intake manifold. The overhead camshaft valvetrain system can include a first and second cylinder head each comprising an overhead valvetrain system having at least one overhead camshaft, at least one valve, and at least one motion converter designed to convert rotational motion of the overhead camshaft into translational motion, the at least one overhead camshaft designed to actuate the at least one valve via the at least one motion converter, wherein the first and second cylinder heads are fastened to the block. In some embodiments, the overhead camshaft valvetrain system can include a transmission system which operably couples the at least one overhead camshaft to a crankshaft of the existing engine, the transmission system having at least one flexible transmitter, wherein the transmission system is designed to transfer rotational motion of the crankshaft of the existing engine to the at least one overhead camshaft. In some embodiments, the existing engine is an engine from the Chevrolet LS family. In some embodiments, the first cylinder head, the second cylinder head, and the transmission system can be retrofitted onto the existing engine without modification.

In some embodiments, the overhead camshaft valvetrain system can include at least one flexible transmitter comprises at least one of a belt and a chain. In some embodiments, the transmission system can include an intermediate gear operably coupled to the crankshaft of the existing engine, wherein at least a first flexible transmitter couples the intermediate gear to the at least one overhead camshaft. In some embodiments, the intermediate gear can include a first portion having a first plurality of engagement members and an indexed surface, the first plurality of engagement members designed to operably couple with the crankshaft of the existing engine, the indexed surface having a plurality of raised and recessed portions. In some embodiments, the intermediate gear can include a second portion axially spaced from the first portion, the second portion having a second plurality of engagement members for coupling at least the first flexible transmitter to the second portion. In some embodiments, the intermediate gear can include a projection extending between the first portion and the second portion and oriented generally perpendicular to the indexed surface. In some embodiments, the plurality of raised and recessed portions are designed to be used in connection with an existing cam position sensor of the existing engine without changing the original radial distance of the cam sensor relative to the intermediate gear.

In some embodiments, the transmission system can include a plurality of guide members designed to route the at least one flexible transmitter around the engine. In some embodiments, the plurality of guide members can be positioned within an area defined between: a first horizontal plane extending through a rotational axis of an uppermost of the at least one camshaft; a second horizontal plane extending through a rotational axis of the crankshaft; a first vertical plane extending through a rotational axis of an outermost of the at least one camshaft on a first lateral side of the existing engine; and a second vertical plane extending through a rotational axis of an outermost of the at least one camshaft on an second lateral side of the existing engine, the second lateral side being opposite the first lateral side.

In some embodiments, the block of the engine can include a plurality of existing fastener holes and wherein at least one of the plurality of guide members is fastened directly to one of the plurality of existing fastener holes. In some embodiments, the transmission system can include an intermediate gear. In some embodiments, the plurality of guide members can be positioned within an area defined between: a first horizontal plane extending through an uppermost portion of the block, a second horizontal plane extending through a rotational axis of the intermediate gear, a first vertical plane extending through an inboard-most side of an existing first existing fluid aperture of the block, the first existing fluid aperture being on a first lateral side of the engine, and a second vertical plane extending through an inboard-most side of an existing second existing fluid aperture of the block, the second existing fluid aperture being on a second lateral side of the engine, the second lateral side being opposite the first lateral side.

In some embodiments, the block of the engine can include a plurality of existing fastener holes. In some embodiments, at least one of the plurality of guide members is fastened directly to one of the plurality of fastener holes. In some embodiments, the plurality of guide members can include at least one moveable guide member configured to translate relative to the block. In some embodiments, the moveable guide member can translates along a guide path generally parallel to the belt. In some embodiments, at least one motion converter can include at least one of a bucket tappet, a finger follower, a rocker arm, and a pushrod. In some embodiments, at least one overhead camshaft of the first and second cylinder heads each can include an intake camshaft and an exhaust camshaft.

In some embodiments, the overhead camshaft valvetrain system can include a cover having a rear portion having a plurality of apertures designed to receive fasteners for mounting the cover to the block, the apertures being arranged to correspond to one or more existing fastener holes of the block. In some embodiments, the cover can include a front portion axially spaced from the rear portion, the rear portion and front portion defining a space therebetween. In some embodiments, the cover can include a plurality of mounting holes designed to receive fasteners for mounting at least one guide member to the cover.

In some embodiments, an overhead cam cylinder head can be used with an existing cam-in-block engine. In some embodiments, the overhead cam cylinder head can include an overhead valvetrain system having at least one overhead camshaft and a plurality of valves, the at least one overhead camshaft designed to actuate the plurality of valves; and a plurality of intake ports designed to be in fluid communication with the intake manifold and a plurality of piston bores, wherein laterally extending vertical planes bisecting the plurality of intake ports are axially offset from longitudinal axes of the plurality of piston bores. In some embodiments, the existing engine is an engine from the Chevrolet LS family. In some embodiments, the cylinder head can replace a cylinder head of the existing engine without modification to the block and intake manifold. In some embodiments, the cylinder head can include a plurality of exhaust ports configured to be in fluid communication with an exhaust manifold of the existing engine and the cylinder head can replace a cylinder head of the existing engine without modification to the exhaust manifold.

In some embodiments, an oil feed system can be used with an existing oil feed system of an existing engine, the existing engine having at least a plurality of existing lifter passageways in fluid communication with a left oil galley, a plurality of existing lifter passageways in fluid communication with a right oil galley, and a bearing fluid passageway in fluid communication with the left oil galley. In some embodiments, the oil feed system can include an oil feed element positioned within at least one of the existing lifter passageways in fluid communication with at least one of the left oil galley and the right oil galley, the oil feed element designed to redirect oil from the galley into a cylinder head. In some embodiments, the oil feed system can include an oil feed element positioned within at least one of the existing lifter passageways in fluid communication with the left oil galley and at least one of the existing lifter passageways in fluid communication with the right oil galley, the oil feed element designed to redirect oil from the galleys into a cylinder head. In some embodiments, the oil feed system can include one or more passageway restrictor elements positioned within at least one of the existing lifter passageways in fluid communication with the left oil galley and at least one of the existing lifter passageways in fluid communication with the right oil galley, the passageway restrictor elements designed to inhibit flow of oil through the existing lifter passageways. In some embodiments, the existing engine can be an engine from the Chevrolet LS family.

In some embodiments, one or more passageway restrictor elements are positioned within all of the existing lifter passageways in fluid communication with the left oil galley. In some embodiments, one or more galley restrictor elements are positioned within the right oil galley. In some embodiments, one or more passageway restrictor elements are positioned within a front-most and rear-most existing lifter passageways in fluid communication with the right oil galley.

BRIEF DESCRIPTION OF THE DRAWINGS

Embodiments of the present disclosure will now be described hereinafter, by way of example only, with reference to the accompanying drawings as indicated below.

DETAILED DESCRIPTION

Figure 1A:
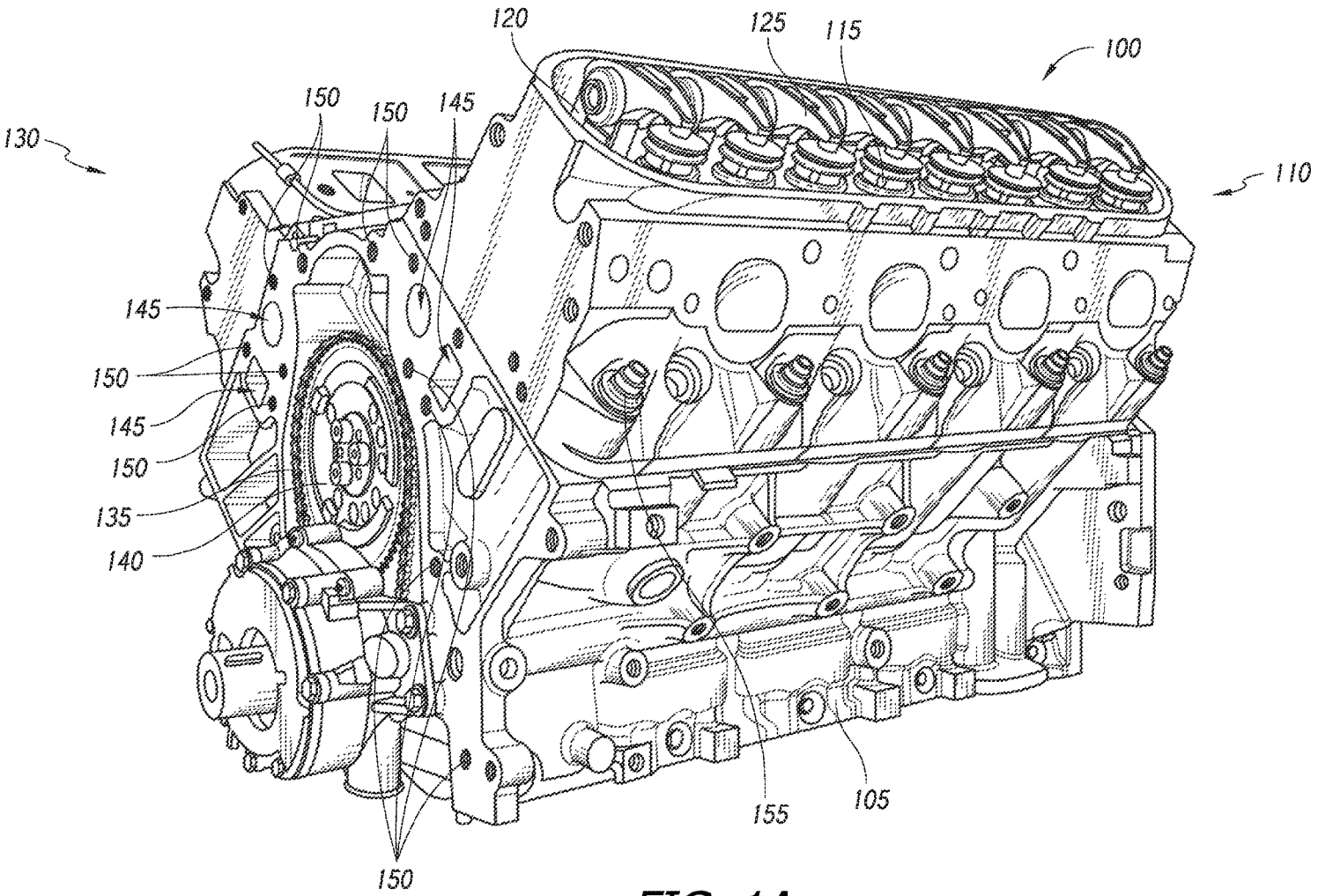
FIG. 1A illustrates a front perspective view of a Chevrolet LS engine having a stock block and stock cylinder heads.

The following detailed description is merely illustrative in nature and is not intended to limit the embodiments of the subject matter or the application and uses of such embodiments. Any implementation described herein as exemplary is not necessarily to be construed as preferred or advantageous over other implementations. Furthermore, there is no intention to be bound by any expressed or implied theory presented in the proceeding technical field, background, brief summary, or the following detailed description.

Certain terminology may be used in the following description for the purpose of reference only, and thus are not intended to be limiting. For example, terms such as "upper", "lower", "above", and "below" refer to directions in the drawings to which reference is made. Terms such as "front", "back", "rear", "left side," and "right side" describe the orientation and/or location of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second", and other such numerical terms referring to structures do not imply a sequence or order unless clearly indicated by the context.

General Description of Cam-In-Block Engines

Certain families of engines, such as the Chevrolet "small-block engine" include a cam-in-block valvetrain system with an overhead valve design. One example of such a family is the Chevrolet LS family of engines, which includes the LS1, LS2, LS3, LS6, LS7, LSA, LQ4, LQ9, and LT engines. Such a valvetrain system generally suffers from disadvantages due to increased valvetrain mass as a result of additional valvetrain components, such as pushrods and lifters, used to operably connect the camshaft within the stock block to the valves within the cylinder head. This can reduce the maximum engine speed and therefore the maximum engine power for a given amount of torque. Moreover, such valvetrain systems can also suffer from a disadvantage of less optimally designed valve ports, such as lower flow area due to fewer valves per cylinder, which can result in lower volumetric efficiency of the engine.

With reference first to FIG. 1A which illustrates an embodiment of an existing, Chevrolet LS engine 100, the existing engine 100 includes a stock block 105 and cylinder heads 110 for each bank of cylinders. For purposes of clarity, other components of the existing engine 100, such as the intake manifold and the exhaust manifold, have been omitted. The valvetrain system of the existing engine 100 includes a single camshaft (not shown) positioned within the stock block 105 at a location below the deck of the cylinder heads 110. The valvetrain system also includes multiple overhead valves 115 positioned within the cylinder head 110 with a single intake valve and a single exhaust valve per cylinder of the existing engine 100. In order to actuate the valves 115 via the camshaft, the valvetrain system includes a complex series of lifters (not shown), pushrods 120, and rocker arms 125 operably coupling the camshaft to the valves 115. This complex series of valvetrain components run from the stock block 105 to the cylinder heads 110 and thus add a significant amount of mass to the valvetrain system.

As shown along a front side 130 of the existing engine 100, the single camshaft is driven by the crankshaft via a chain 135 coupled to a gear (not shown) attached to the crankshaft and a gear 140 attached to the camshaft, which is positioned within the stock block 105. The front side 130 of the existing engine 100 includes plurality of apertures 145 for a fluid flow passageway. In the Chevrolet LS engine of families, such passageways are used for the flow of coolant into and out of the stock block 105. These apertures 145 are designed to be fluidically coupled to a circulation system for higher-temperature coolant to be transferred to a cooling device, such as a radiator, and for lower-temperature coolant to be transferred back to the stock block 105. The front side 130 of the existing engine also includes a plurality of fastener holes 150 designed to receive and engage fasteners for attachment of various components, such as a cover (not shown), over the chain 135 and gear 140. Generally, the fastener holes 150 are designed to engage threads of a screw, bolt, stud or the like.

Figure 1B:
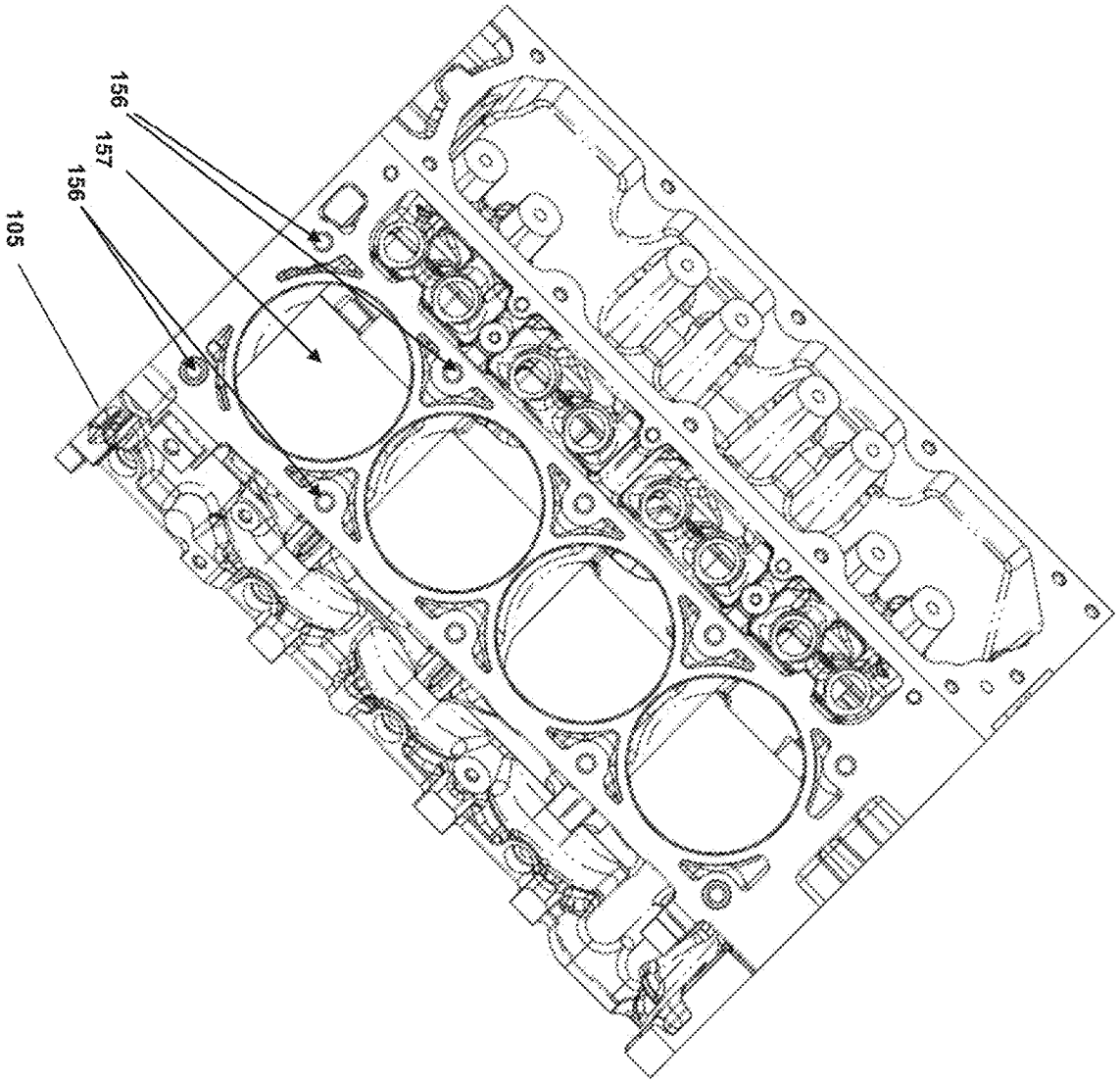
FIG. 1B illustrates a view of the stock block of FIG. 1A orthogonal to a cylinder bank.

With reference to FIGS. 1A and 1B, the two cylinder heads 110 for each bank of cylinders is coupled to the stock block 105 using a plurality of fasteners 155. These fasteners 155, and the holes, such as holes 156, to with which they are engaged, are arranged in a symmetric, repeatable pattern about the centerline of the cylinder bore 157

While FIG. 1A illustrates an LS engine, also referred to as Generation 3 and/or Generation 4 of the Chevrolet Small Block engine, it should be understood that the systems described herein can be used with other engines, such as other Chevrolet "small-block engines" and including those denoted as Generation 1, Generation 2, and/or Generation 5.

Transmission System

Figure 2:
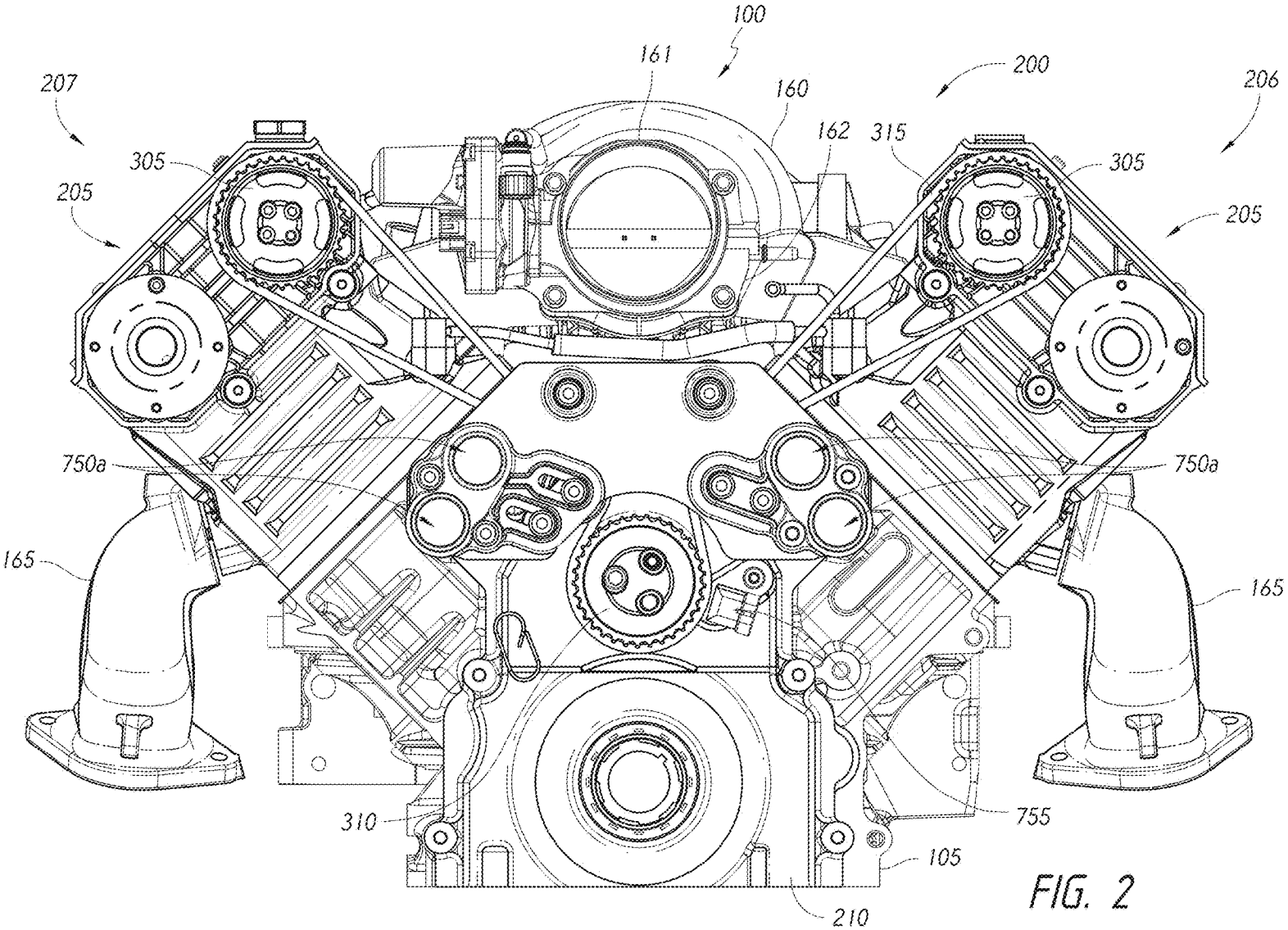
FIG. 2 illustrates a front elevation view of an embodiment of an overhead camshaft valvetrain system for use with existing engine components, such as a stock block, a stock intake manifold, and stock exhaust manifolds.
Figure 3:
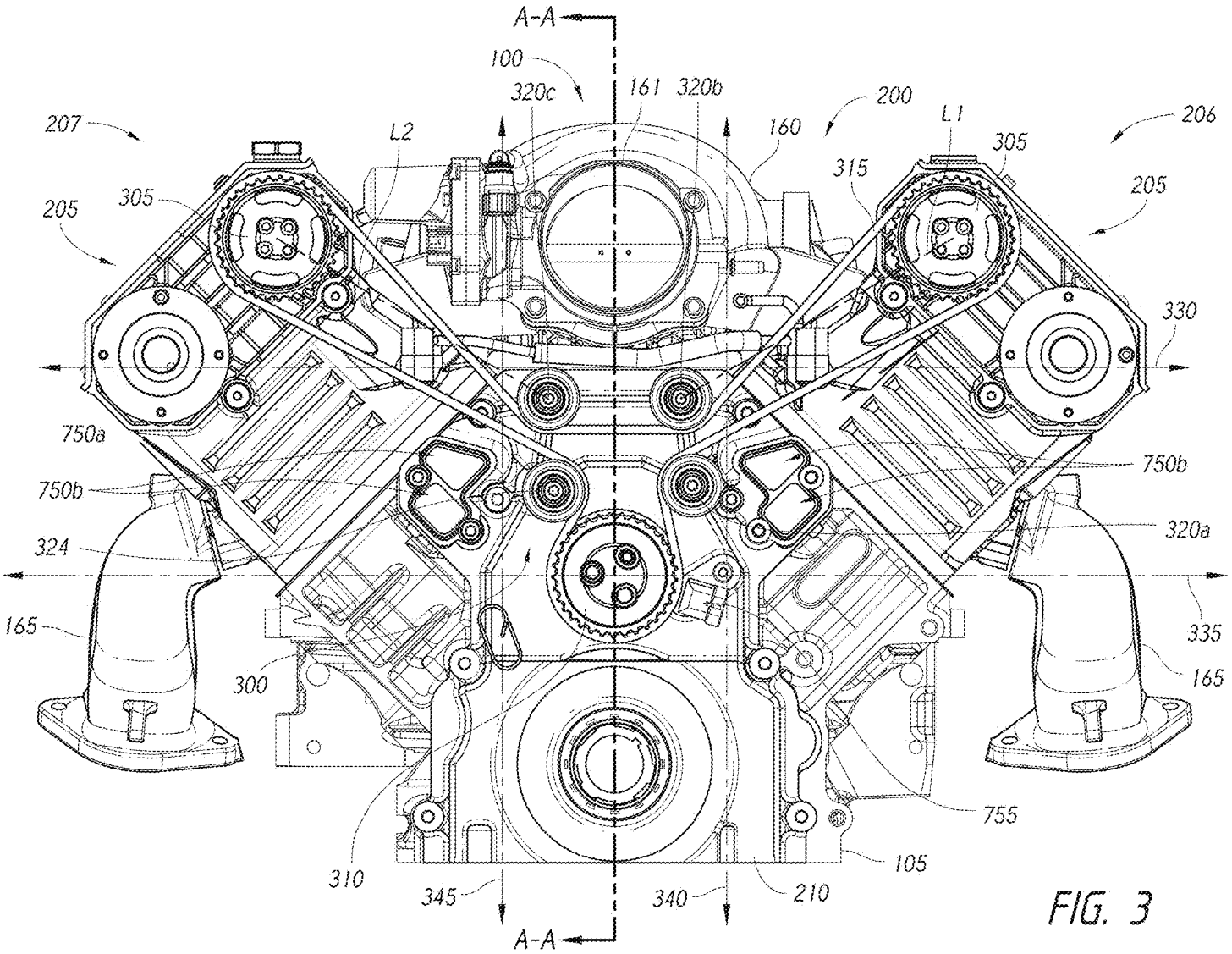
FIG. 3 illustrates a front elevation view of the overhead camshaft valvetrain system of FIG. 2 with a portion of a cover removed to expose underlying components.
Figure 4:
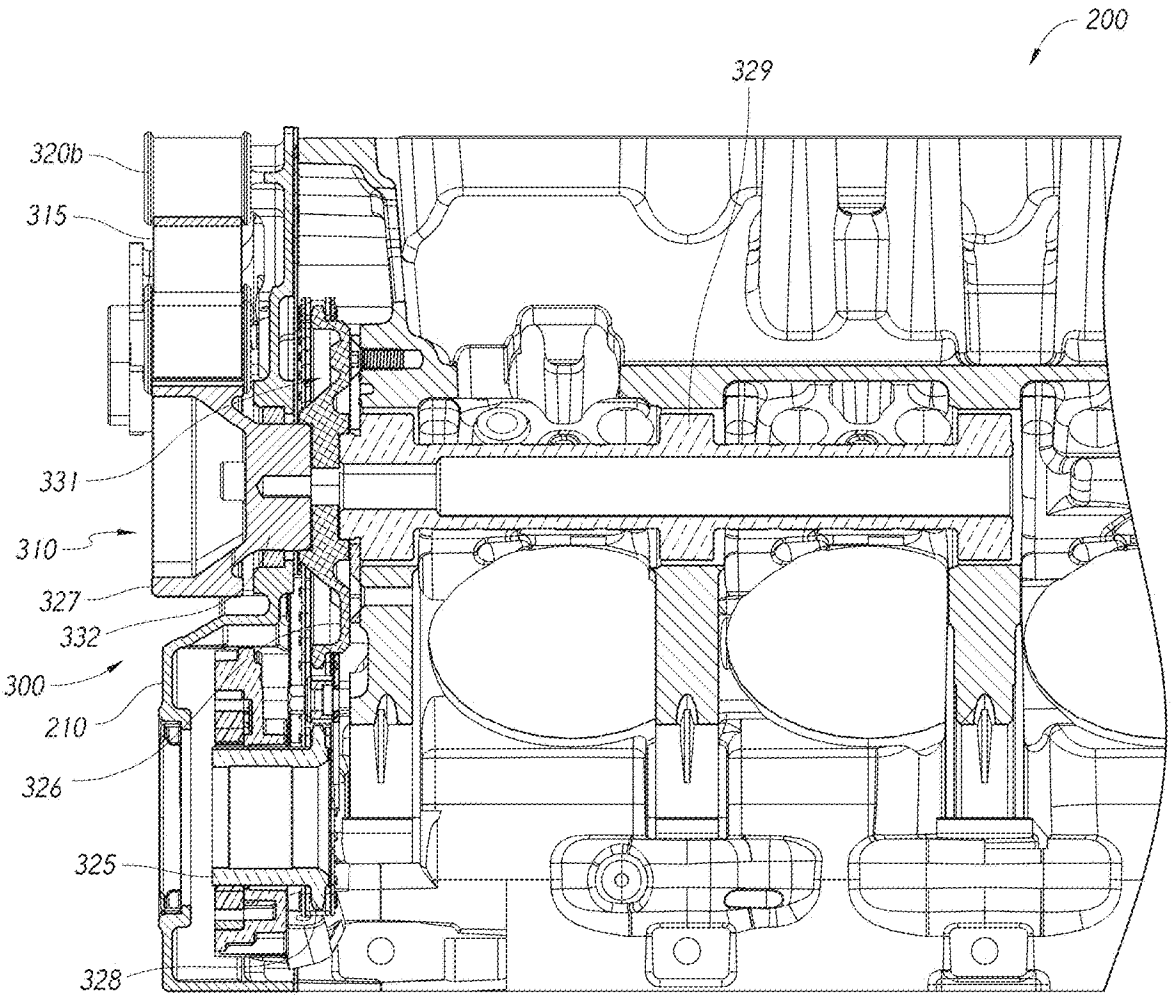
FIG. 4 illustrates a cross-sectional view of an embodiment of components of a transmission system of the overhead camshaft valvetrain system of FIG. 3 along line A-A.

FIGS. 2-4 illustrate an embodiment of an overhead camshaft valvetrain system 200 applied to an existing engine 100. The valvetrain system 200 can be used with components of an existing engine, such as the existing engine 100 of FIG. 1A, including the stock block 105, the intake manifold 160, and the exhaust manifolds 165. As will be described in greater detail below, in some embodiments, the valvetrain system 200 can be retrofitted onto the existing engine 100 such that no modifications are made to components of the existing engine 100 to attach the valvetrain system 200 to the existing engine 100. That is, the valvetrain system 200 can be a direct bolt-on kit for the existing engine 100 which merely replaces, rather than modifies, components of the existing engine. For example, the components of the valvetrain system 200 can be used with the stock block 105, intake manifold 160 and the exhaust manifolds 165 without drilling into these components of the existing engine 105. Moreover, this can advantageously allow the valvetrain system 200 to be used with aftermarket components which are designed to be directly bolted on to the existing engine 100.

With reference first to FIG. 2, as shown in the illustrated embodiment, the valvetrain system 200 can include an overhead cam cylinder head 205 for each bank of cylinders on a left side 206 and a right side 207 of the existing engine 100. These cylinder heads 205 can be coupled to the stock block 105, the intake manifold 160, and the exhaust manifolds 165 of the existing engine 100. As shown in the illustrated embodiment, the valvetrain system 200 can include a cover 210 attached to a front side 130 of the stock block 105, which cover 210 can overlie, enclose, or protect certain internal components of the engine. Moreover, as will be described in greater detail below, the cover 210 can provide mounting points for additional components of the valvetrain system 200.

With reference next to FIG. 3, which shows a portion of the cover 210 removed to expose underlying components of the valvetrain system 200, the valvetrain system 200 can include a transmission system 300 to operably couple one or more overhead cams within the cylinder heads 205 to the crankshaft of the existing engine 100. As shown in the illustrated embodiment, the transmission system 300 can include one or more camshaft gears 305, such as an intake camshaft gear, coupled to an intermediate gear 310 via a flexible transmitter 315, such as a belt. Other flexible transmitters, such as a chain, are also contemplated. In some embodiments, two or more flexible transmitters can be used to couple the camshaft gears 305 to the intermediate gear 310. The one or more flexible transmitters 315 and/or the gears 305, 310 can include features, such as teeth, which enhance traction between the flexible transmitter 315 and/or gears 305, 310. This can advantageously reduce the likelihood of slippage between these components. In some embodiments, gears can be used to couple the camshaft gears 305 to the intermediate gear 310. These gears can be used solely or in combination with the one or more flexible transmitters 315.

With reference next to FIG. 4, in some embodiments, the intermediate gear 310 can be coupled to the crankshaft of the existing engine 100 via a crankshaft gear 325. In some embodiments, the two gears 310, 325 can be coupled together via one or more flexible transmitters 328, such as a chain. Other flexible transmitters, such as a belt, are also contemplated. In some embodiments, gears can be used to couple the intermediate gear 310 to the crankshaft gear 325. These gears can be used solely or in combination with the one or more flexible transmitters 328. In some embodiments, the intermediate gear 310 can be directly meshed with the crankshaft gear 325.

As shown in the illustrated embodiment, the intermediate gear 310 can include a first portion 326 which engages the flexible transmitter 328 coupling the intermediate gear 310 to the crankshaft gear 325. The first portion 326 can include an axially recessed portion 331, which can include an indexed surface having a plurality of raised and recessed portions. The indexed surface can be designed to function with a cam position sensor (755 as shown in FIGS. 2, 3 and 17-19). In some embodiments, the indexed surface can be used with existing cam position sensor of the existing engine without changing the original radial distance of the existing cam sensor relative to the rotational axis of the original camshaft. In some embodiments, the axial distance between the cam position sensor and the indexed surface can be the same as in the existing engine. In some embodiments, the cam position sensor can be positioned such that the cam position sensor is positioned rearward of one or more flexible transmitters, such as the flexible transmitter 315.

The intermediate gear 310 can also include a second portion 327 which can engage the one or more flexible transmitters 315 coupling the intermediate gear 310 to the one or more camshaft gears 305, such as intake camshaft gears. The second portion 327 can be axially spaced from the first portion 326 and attached to the first portion via a projection 332 to transfer rotational motion of the first portion 326 to the second portion 327. In some embodiments, the intermediate gear 310 can be constructed such that the first portion 326 and the second portion 327 are also rotatably adjustable relative to each other, such that the first portion 326 can be rotated relative to the second portion 327. This can allow valve timing adjustment. In some embodiments, the first portion 326 and the second portion 327 can include fixed In some embodiments, the intermediate gear 310 can be rotatably coupled to the cover 210 along the projection 332. A bearing or sealing member can be positioned between the intermediate gear 310 and the cover 210. In some embodiments, the crankshaft gear 325 and flexible transmitter can be the crankshaft gear and/or chain 135 used with the existing engine 100 to couple the crankshaft gear of the existing engine 100 to the camshaft gear 140 of the existing engine 100. In some embodiments, the intermediate gear 310 can be positioned about the rotational axis of the original camshaft location of the existing engine 100. For example, the intermediate gear 310 can be attached to the stock camshaft, a replacement "dummy" shaft 329, or some other component centered on the rotational axis of the original camshaft.

With reference back to FIG. 3, the transmission system 300 can include one or more guide members, such as pulleys, chain guides, and the like, to route one or more of the flexible transmitters, such as flexible transmitters 315, 328, around various components of the existing engine 100 and valvetrain system 200. Some guide members can be stationary (i.e., rotatable about a fixed axial location) whereas others can be moveable or adjustable, for example, to maintain tension in one or more flexible transmitters 315, 328. As shown in the illustrated embodiment, the transmission system 300 can include one or more idler pulleys 320*a*, 320*b*, 320*c* to route the flexible transmitter 315 around various components and one or more tensioner pulleys 324 to route the flexible transmitter 315 and ensure that an adequate amount of tension is maintained in the flexible transmitter 315 to reduce the likelihood of slippage between the belt 315 and gears 305, 310. As such, these pulleys 320*a*, 320*b*, 320*c*, 324 are guide members, with the idler pulleys 320*a*, 320*b*, 320*c* being stationary guide members and the tensioner pulley 324 being an adjustable guide member In some embodiments, the adjustable guide member, such as the tensioner pulley 324, can be adjustable in such a manner that a clearance between an upper run of the flexible transmitter, such as the flexible transmitter 315, and another run of the flexible transmitter in contact with the adjustable guide member, can be maintained as the adjustable guide member is moved. In some embodiments, the adjustable guide member, such as the tensioner pulley 324, can be adjustable in such a manner that a clearance between a run of the flexible transmitter, such as the flexible transmitter 315, in contact with the adjustable guide member and the water passages, such as such as existing coolant apertures 145, the ports 750*a*, 750*b* and/or the passageways of the cover 210, can be maintained.

As shown in the illustrated embodiment, one or more of the guide members, such as the idler pulleys 320*b*, 320*c*, can be fastened directly to existing fasteners holes, such as the fastener holes 150, of the stock block 105. This can advantageously benefit from the structural integrity of the stock block 105. Moreover, some guide members, such as the idler pulley 320*a*, can be positioned near existing fastener holes and can be indirectly attached to the stock block 105 using an intermediate component, such as the cover 210. It is also contemplated that some guide members can be attached to other components of the existing engine 100 and/or the valvetrain system 200, such as the cylinder heads 205.

As noted above, the guide members can be arranged to route one or more flexible transmitters around various components of the existing engine 100. As shown in the illustrated embodiment, the existing engine 100 is a Chevrolet LS engine, which includes apertures 145 to allow for the ingress and egress of coolant into and out of the stock block 105. Accordingly, it can be advantageous to route the flexible transmitter around these existing apertures 145 so that the existing apertures 145 can be used without modifications to the stock block 105.

As shown in the illustrated embodiment, the guide members, such as the pulleys 320*a*, 320*b*, 320*c*, 324, can be arranged such that some or all of the guide members are positioned within an area defined between a first plane 330 extending horizontally through an uppermost portion of the stock block 105, a second plane 335 extending horizontally through a rotational axis of the intermediate gear 310, a first plane 340 extending vertically inboard of a water passage, such as existing coolant aperture 145, the ports 750*a*, 750*b* and/or the passageways of the cover 210, on a left side of the stock block 105, and a second plane 345 extending vertically inboard side of a water passage, such as existing coolant aperture 145, the ports 750*a*, 750*b* and/or the passageways of the cover 210, on a right side of the stock block 105. In some embodiments, the guide members can be arranged such that some or all of the guide members are positioned within an area defined by less than four planes, such one plane, two planes, or three planes. For example, in some embodiments, the guide members can be arranged such that some or all of the guide members are positioned between the first plane 340 and the second plane 345. As another example, in some embodiments, the guide members can be arranged such that some or all of the guide members are positioned above the second plane 335.

Other arrangements of guide members are contemplated. FIGS. 21A-G and 22A-22K illustrate various arrangements of guide members 350 for a transmission system in which one or more camshaft gears 305 are coupled to an intermediate gear 310 via one or more flexible transmitters 315. It is also contemplated that one or more camshaft gears 305 can be coupled to the crankshaft gear 325 via one or more flexible transmitters 315. In some embodiments, such as those illustrated in FIGS. 23A-23F, the intermediate gear can be omitted entirely such that one or more camshaft gears 305 are coupled to the crankshaft gear 325 via one or more flexible transmitters 315.

In some embodiments, the guide members 350 can be arranged such that some or all of the pulleys are positioned within an area defined between a first plane extending horizontally through a rotational axis of an uppermost camshaft gear 305 to which a flexible transmitter 315 is coupled, a second plane extending horizontally through a rotational axis of the crankshaft, a first plane extending vertically through a longitudinal axis of an outermost camshaft gear 305 to which a flexible transmitter 315 is coupled, on a left side of the stock block 105, and a second plane extending vertically through a rotational axis of an outermost camshaft gear 305 to which a flexible transmitter 315 is coupled, on a right side of the stock block 105.

While a certain subset of planes have been described above, it is also contemplated that horizontal and vertical planes passing through other features of the existing engine 100 and/or valvetrain system 200 can be used. For example, such planes can pass through any of (i) an outboard-most portion, (ii) an uppermost portion, (iii) an inboard-most portion, (iv) a lowermost portion, (v) a longitudinal axis, and/or (iv) a rotational axis of any of (1) an uppermost camshaft gear to which a flexible transmitter is coupled, (2) an outboard-most camshaft gear to which a flexible transmitter is coupled, (3) a lowermost camshaft gear to which a flexible transmitter is coupled, (4) an inboard-most camshaft gear to which a flexible transmitter is coupled, (5) an intermediate gear, such as the intermediate gear 310, (6) a crankshaft gear, such as the crankshaft gear 325, (7) an existing aperture of the stock block 105, such as the coolant aperture 145, (8) existing fastener holes, (9) the cylinder heads 205, (10) water passages, such as the ports 750*a*, 750*b* or the passageways of the cover 210, and/or other features of the existing engine 100 and/or valvetrain system 200. In some embodiments, the guide members can be arranged such that some or all of the guide members are positioned within an area defined by less than four planes, such as one plane, two planes, or three planes. For example, the guide members can be arranged such that some or all of the guide members are positioned above or below a single horizontal plane, that some or all of the guide members are positioned to the right of or to the left of a single vertical plane, and/or that some or all of the guide members are positioned between two or three planes.

In some embodiments, one or more guide members can be positioned below a plane of an uppermost driven gear, such as the cam gear 305, and inboard of an outermost driven gear, such as the cam gear 305, such that a portion of least one flexible transmitter, such as the flexible transmitter 315, is positioned below an intake plenum 161 and/or throttle body 162. In some embodiments, one or more guide members can be positioned such that at least one guide member keeps a portion of a flexible transmitter, such as the flexible transmitter 315, above water passages, such as existing coolant aperture 145, the ports 750*a*, 750*b* and/or the passageways of the cover 210, and below the intake plenum 161 and/or throttle body 162. In some embodiments, one or more guide members can be positioned such that at least one guide member is positioned on the stock block 105 and/or the cylinder head 205 to route at least a portion of at least one flexible transmitter, such as the flexible transmitter 315, below an air intake system of the existing engine, such as the intake manifold 160, the intake plenum 161, and the throttle body 162, and above the water passages, such as existing coolant aperture 145, the ports 750*a*, 750*b* and/or the passageways of the cover 210, to provide clearance for at least one flexible transmitter, such as the flexible transmitter 315. This can allow the use of the water passages, such as existing coolant aperture 145, the ports 750*a*, 750*b* and/or the passageways of the cover 210 and the stock intake plenum 161 and/or throttle body 162.

In some embodiments, at least one guide member can be mounted above a horizontal plane running through a centerline of an intermediate gear, such as intermediate gear 310, and inboard of water passages, such as existing coolant aperture 145, the ports 750*a*, 750*b* and/or the passageways of the cover 210, to route least a portion of a flexible transmitters, such as the flexible transmitter 315. This can advantageously provide a compact form factor for the transmission system 300 which can beneficially allow fitment of other engine accessories and other components (e.g., alternator, water pump, power steering pump) within a smaller engine bay.

In some embodiments, at least one guide member can be mounted on the head, such as cylinder head 205, and/or the stock block, such as the stock block 105, and can be positioned outboard of the outermost water passages, such as existing coolant aperture 145, the ports 750*a*, 750*b* and/or the passageways of the cover 210, to route at least a portion of a flexible transmitter, such as flexible transmitter 315, below and/or outside of the outermost water passages, such as existing coolant aperture 145 and/or ports 750*a*, 750*b* or passageways of the cover 210.

In some embodiments, at least one guide member can be mounted on the head, such as the cylinder head 205, or the block, such as the stock block 105, and can be positioned to locate at least a portion of a flexible transmitter, such as flexible transmitter 315, between a coolant inlet of the water passages, such as existing coolant aperture 145 and/or ports 750*a*, 750*b* or passageways of the cover 210, and a coolant outlet of the water passages, such as existing coolant aperture 145, the ports 750*a*, 750*b* and/or the passageways of the cover 210, on one or both sides of the block. This can advantageously provide a more direct path for at least a portion of a high tension portion of a flexible transmitter, such as flexible transmitter 315. In some embodiments, the high tension side of a flexible transmitter can be on the side of an intermediate gear, such as intermediate gear 310, or crankshaft gear, such as crankshaft gear 325, where the flexible transmitter is translating towards the intermediate gear and/or crankshaft gear. The portion of the flexible transmitter translating away from the intermediate gear and/or crankshaft gear is a low tension side of the flexible transmitter. By routing the flexible transmitter in a more linear manner, particularly on the higher tension side, the performance of the flexible transmitter can be enhanced.

In some embodiments, at least one guide member can be positioned directly over water passages, such as existing coolant aperture 145 and/or the ports 750*a*, 750*b* or the passageways of the cover 210. This can beneficially allow water to pass through a rotational or attachment axis of the guide member.

In some embodiments, the guide members can be arranged such that a line L1 intersecting top-most guide member on a left side 206 of the existing engine 100, such as the idler pulley 320*b*, and a camshaft gear 305, such as the intake camshaft gear and/or the exhaust camshaft gear, passes above the water passages, such as existing coolant aperture 145, the ports 750*a*, 750*b* and/or the passageways of the cover 210, of the existing engine 100 and/or below a plenum 161. In some embodiments, the guide members can be arranged such that a line L2 intersecting top-most guide member on a right side 207 of the existing engine 100, such as the idler pulley 320*c*, and a camshaft gear 305, such as the intake camshaft gear and/or the exhaust camshaft gear, passes above the water passages, such as existing coolant aperture 145, the ports 750*a*, 750*b* and/or the passageways of the cover 210, of the existing engine 100 and/or below a plenum 161. In some embodiments, the guide members can be arranged such that at least two runs of a flexible transmitter, such as the flexible transmitter 315, passes above the water passages, such as existing coolant aperture 145, the ports 750*a*, 750*b* and/or the passageways of the cover 210, and/or below the plenum 161.

Overhead Camshaft Cylinder Heads

Figure 5A:
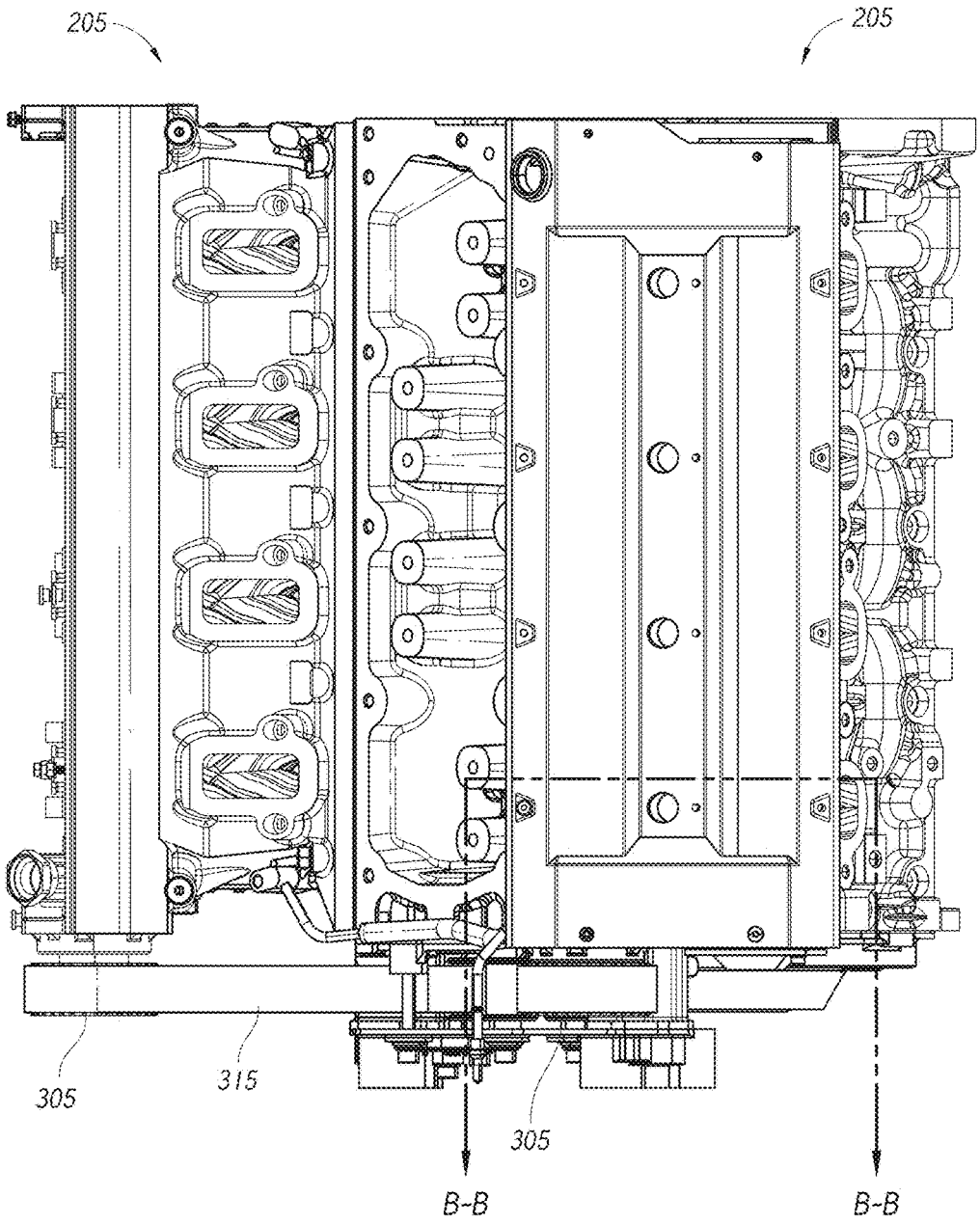
FIG. 5A illustrates a top view of an embodiment of a cylinder head of the overhead camshaft valvetrain system of FIG. 2.
Figure 5B:
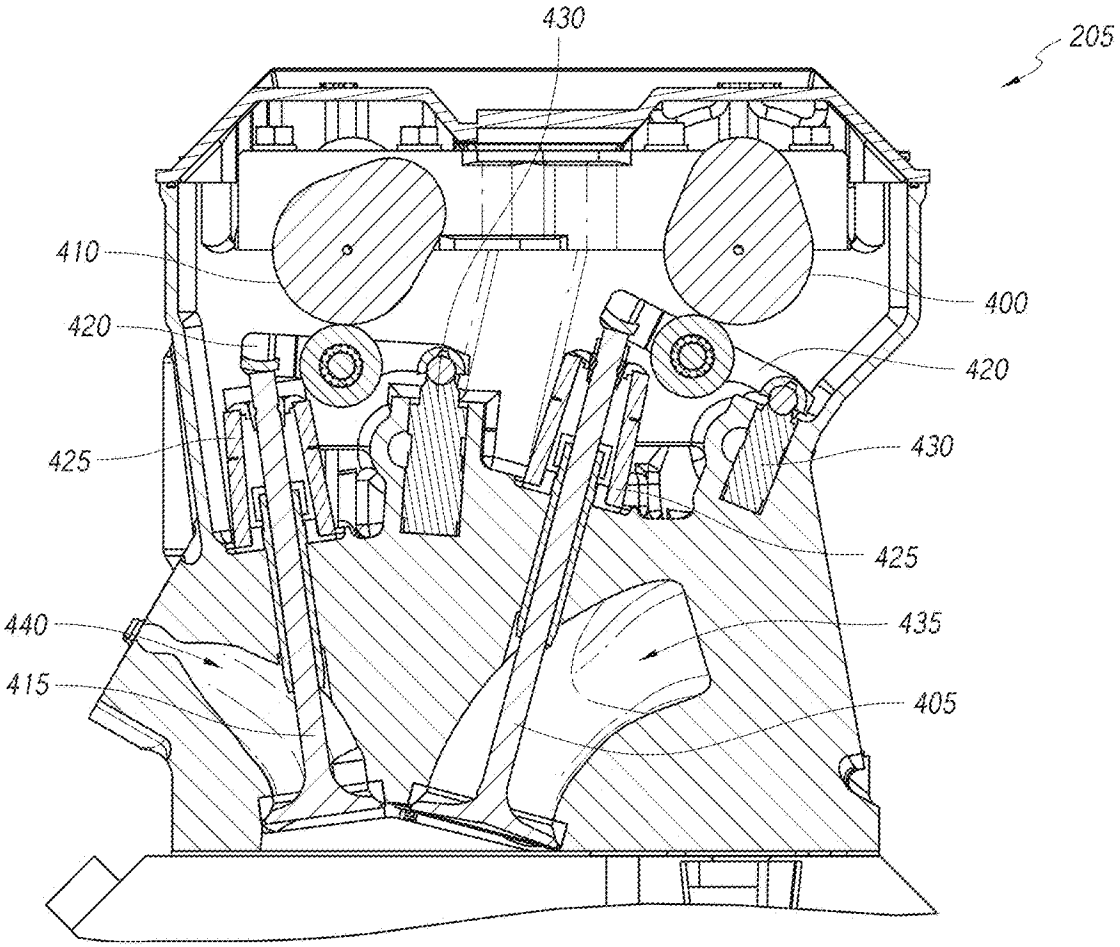
FIG. 5B illustrates a cross-sectional view of an embodiment of the cylinder head and components of FIG. 5A along line B-B.

FIGS. 5A and 5B illustrate an embodiment of valvetrain components of the valvetrain system 200 positioned within the cylinder head 205. As shown in the illustrated embodiment, the cylinder head 205 can include an intake camshaft 400 for actuating one or more intake valves 405 of the cylinder head 205 and an exhaust camshaft 410 for actuating one or more exhaust valves 415 of the cylinder head 205. In some embodiments, the valvetrain system 200 can include two intake valves 405 and two exhaust valves 415 per cylinder. The cylinder head 205 may have greater or fewer than two camshafts 400, 410. For example, in some embodiments the cylinder head 205 can include a single camshaft for actuating both the intake valves 405 and the exhaust valves 415. Moreover, the cylinder head 205 may have greater or fewer than two intake valves 405 and/or exhaust valves 415 per cylinder.

The cylinder head 205 can include one or more motion converters, such as finger followers 420, to convert rotational motion of the camshafts, such as the intake camshaft 400 and the exhaust camshaft 410, into translational motion of the valves, such as the intake valves 405 and the exhaust valves 415. Other types of motion converters, such as bucket tappets and rocker arms, can also be used. As shown in the illustrated embodiment, biasing mechanisms 425, such as valve springs, can be coupled to the one or more of the valves 405, 415 to bias the valves 405, 415 towards a closed position when not being actuated by the corresponding camshaft 400, 410. Other biasing mechanisms, such as pneumatic mechanisms, can also be used to bias one or more of the valves 405, 415 towards a closed position. As shown in the illustrated embodiment, adjustment mechanisms 430, such as lash adjusters, can contact an end of the finger followers 420 to reduce gaps between components of the valvetrain system. In some embodiments, the adjustment mechanisms 430 can serve as a pivot point for the finger followers 420. In some embodiments, one or more adjustment mechanisms 430 can be attached to one or more finger followers 420. Other types of adjustment mechanisms can also be used.

During operation, the intake valves 405 control the ingress of combustion reactants, such as air and/or fuel, from the intake manifold (not shown), through the intake runners 435 and into the combustion chamber below. The exhaust valves 415 control the egress of combustion products, such as $H_2O$, CO, $CO_2$, $NO_x$, and unburned hydrocarbons out of the combustion chamber, through the exhaust runners 440, and into the exhaust manifold (not shown). The valvetrain system 200 can allow for significantly increased performance by allowing higher engine rpm, higher valve opening and closing rates, more precise control of the valve lift, the duration the valve is opened, and the valve timing, as well as allowing for increased flow area via, for example, a greater number of valves.

FIGS. 6-9 illustrate various views of an embodiment of a housing 500 of the overhead cam cylinder head 205. For purposes of clarity, other components of the cylinder head 205, such as the camshafts 400, 410, the valves 405, 415, the finger followers 420, the valve springs 425, the lash adjusters 430, and other such components have been omitted. In some embodiments, the same housing 500 can be used on both sides of the existing engine 105.

Figure 6:
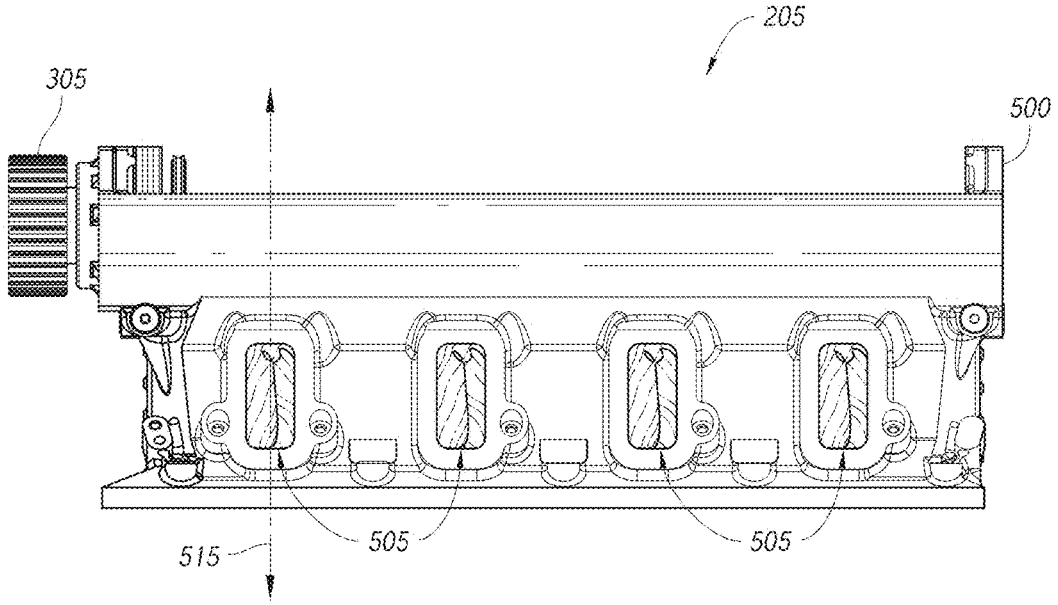
FIG. 6 illustrates a left side elevation view of an embodiment of a cylinder head and camshaft gear.
Figure 7:
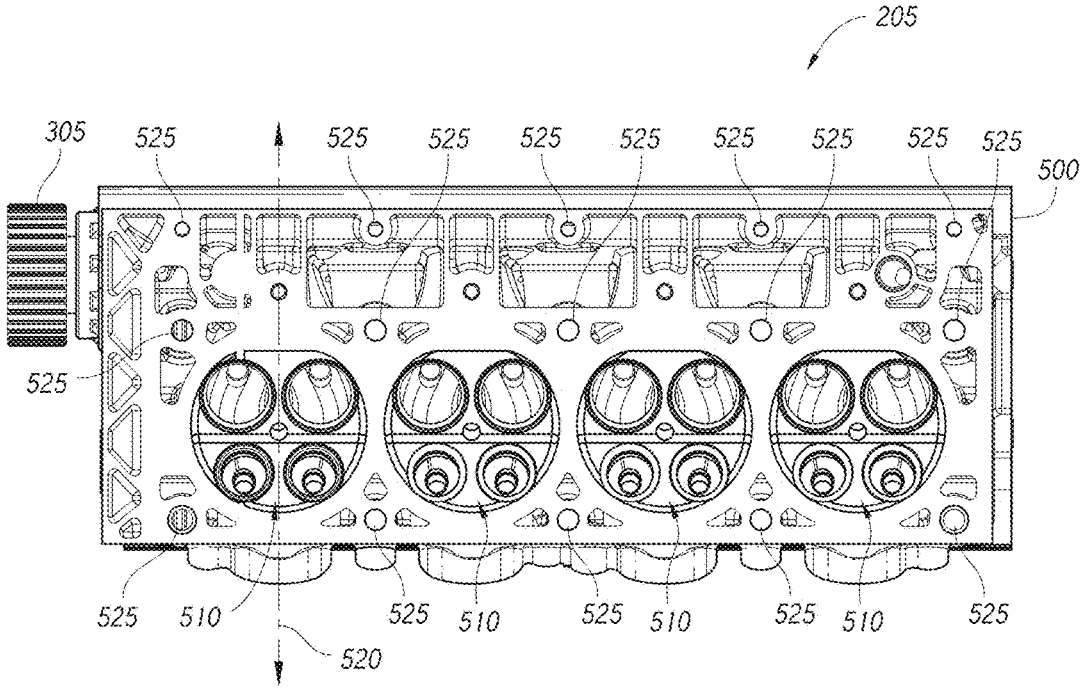
FIG. 7 illustrates a bottom elevation view of the cylinder head and camshaft gear of FIG. 6.

With reference first to FIGS. 6 and 7, the housing 500 can include a plurality of intake ports 505 that are fluidically coupled to the intake runners 435. In some embodiments, the plurality of intake ports 505 are positioned such that the intake manifold 160 of the existing engine 100 can be used with the cylinder head 205 without modifying the placement of the stock intake manifold 160 relative to the stock block 105 of the existing engine 100 and/or without modifications to the intake manifold 160 itself. With respect to certain engine families, such as the Chevrolet LS family of engines, this can be accomplished by offsetting the intake ports 505 relative to the cylinder bore 510. For example, a centerline 515 of the intake ports 505 can be axially offset, in a direction along the rotational axis of the crankshaft, from a centerline 520 of the cylinder bore 510. In some embodiments, a centerline 515 of the intake port 505 for a cylinder can be axially offset, in a direction along the rotational axis of the crankshaft, from a centerline between two intake valves for a cylinder. Moreover, in some embodiments, the plurality of intake ports 505 can be positioned such that the ports of the intake manifold 160 can be fluidically coupled to the intake ports 505 without use of an additional adaptor positioned therebetween to redirect fluid flow from the intake manifold 160 to the intake ports 505. This can advantageously allow for use of aftermarket intake manifolds designed for use with the existing engine 100.

With reference to FIG. 7, the housing 500 can be coupled to the stock block 105 of the existing engine 100 using the same fastener holes as those used for coupling the cylinder heads 110 of the existing engine 100 to the stock block 105 of the existing engine 100. Accordingly, in some embodiments, the fastener holes 525 for mounting the housing 500 to the stock block 105 can be aligned with the existing fastener holes of the stock block 105. Use of the existing fastener holes can advantageously reduce the amount of time and work needed to couple the cylinder heads 205 to the stock block 105 of the existing engine 100. Moreover, in such an embodiment, since no modification is made to the stock block 105, there is a reduced likelihood that the structural integrity of the stock block 105 could potentially be compromised, which may impair performance and reduce longevity of the stock block 105.

Figure 8:
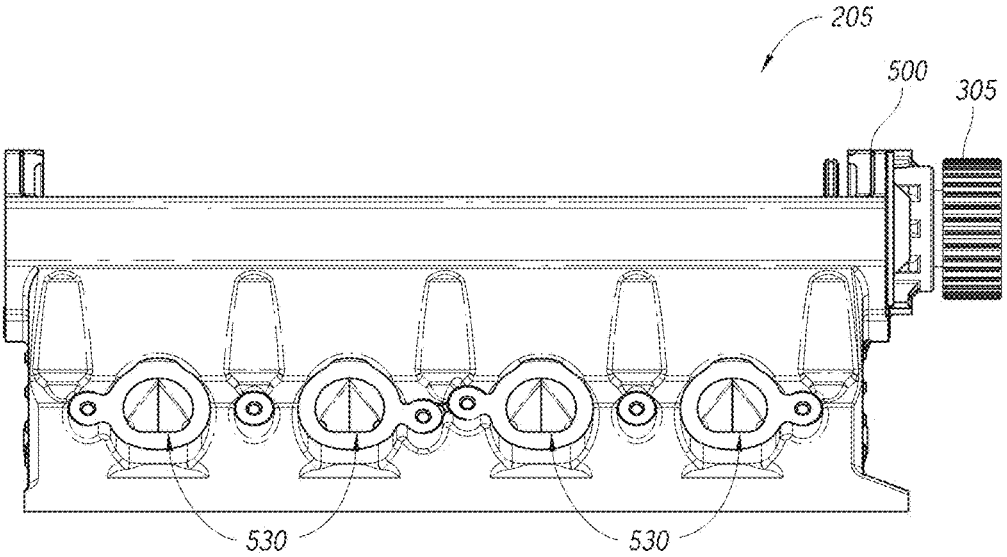
FIG. 8 illustrates a right side elevation view of the cylinder head and camshaft gear of FIG. 6.
Figure 9:
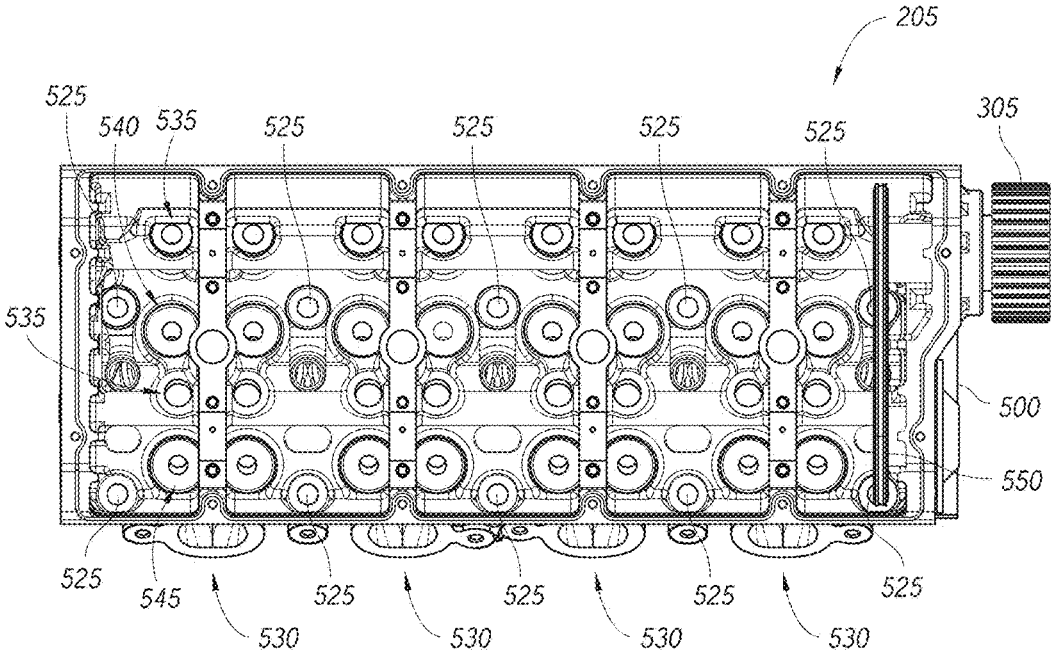
FIG. 9 illustrates a top plan view of the cylinder head and camshaft gear of FIG. 6.

With reference now to FIGS. 8 and 9, the housing 500 can include a plurality of exhaust ports 530 that are fluidically coupled to the exhaust runners 440. In some embodiments, the plurality of exhaust ports 530 are positioned such that the exhaust manifolds 165 for the existing engine 100 can be used with the cylinder head 205 without modifications to the exhaust manifolds 165 relative to the stock block 105 and/or without modifications to the exhaust manifolds 165 themselves. Moreover, in some embodiments, the plurality of exhaust ports 530 can be positioned such that the ports of the exhaust manifold 165 can be fluidically coupled to the exhaust ports 530 without the use of an additional adaptor positioned therebetween. This can advantageously allow the use of aftermarket exhaust manifolds designed for use with the existing engine 100.

With reference to FIG. 9, the housing 500 can include recesses 535 for the adjustment mechanisms 430, such as the lash adjusters, seats 540 for biasing mechanisms 425, such as the valve springs attached to the intake valves 405, and seats 545 for biasing mechanisms 425, such as the valve springs attached to the exhaust valves 415. Moreover, as shown in the illustrated embodiment, the valvetrain system 200 can include a flexible transmitter 550, which couples two or more camshafts together.

Oil Feed System

FIGS. 10-16 illustrate various views of an embodiment of an oil feed system 600 of the valvetrain system 200. In converting a "pushrod" or "I-head" engine to the overhead camshaft design of the present disclosure, certain existing elements of the "pushrod" or "I-head" valvetrain system, such as the lifters and the pushrods can be removed as such elements from the existing engine 100 are no longer needed to actuate the valves of the valvetrain system 200. However, as these elements can play a functional role in the oil feed system of the existing engine 100, removal of these elements can decrease performance of the oil feed system and can cause pressure drops through the system. For example, in the Chevrolet LS engine, existing lifters of the valvetrain system are positioned within lifter passageways that are in fluid communication with oil galleys. These existing lifters provide some degree of impedance to fluid flow through these lifter passageways, thereby generating only a slight pressure loss as oil flows through the oil galleys and past these lifter passageways. Upon removal of the existing lifters, oil can more freely flow from the oil galley and through the lifter passageways thereby generating a significant pressure drop at each unimpeded lifter passageway.

Accordingly, in some embodiments, an oil feed system 600 can be implemented with the existing oil feed system to reduce or wholly eliminate this pressure drop as oil flows through the oil galleys and past these lifter passageways. As an alternative to, or in combination with, the oil feed system 600, one can maintain the stock lifters and accept slight pressure drop as oil flows through the oil galleys and past these lifter passageways. As with other components of the valvetrain system 200, the components of the oil feed system 600 can be used with the existing oil feed system such that no permanent modifications are made to the existing oil feed system.

Figure 10:
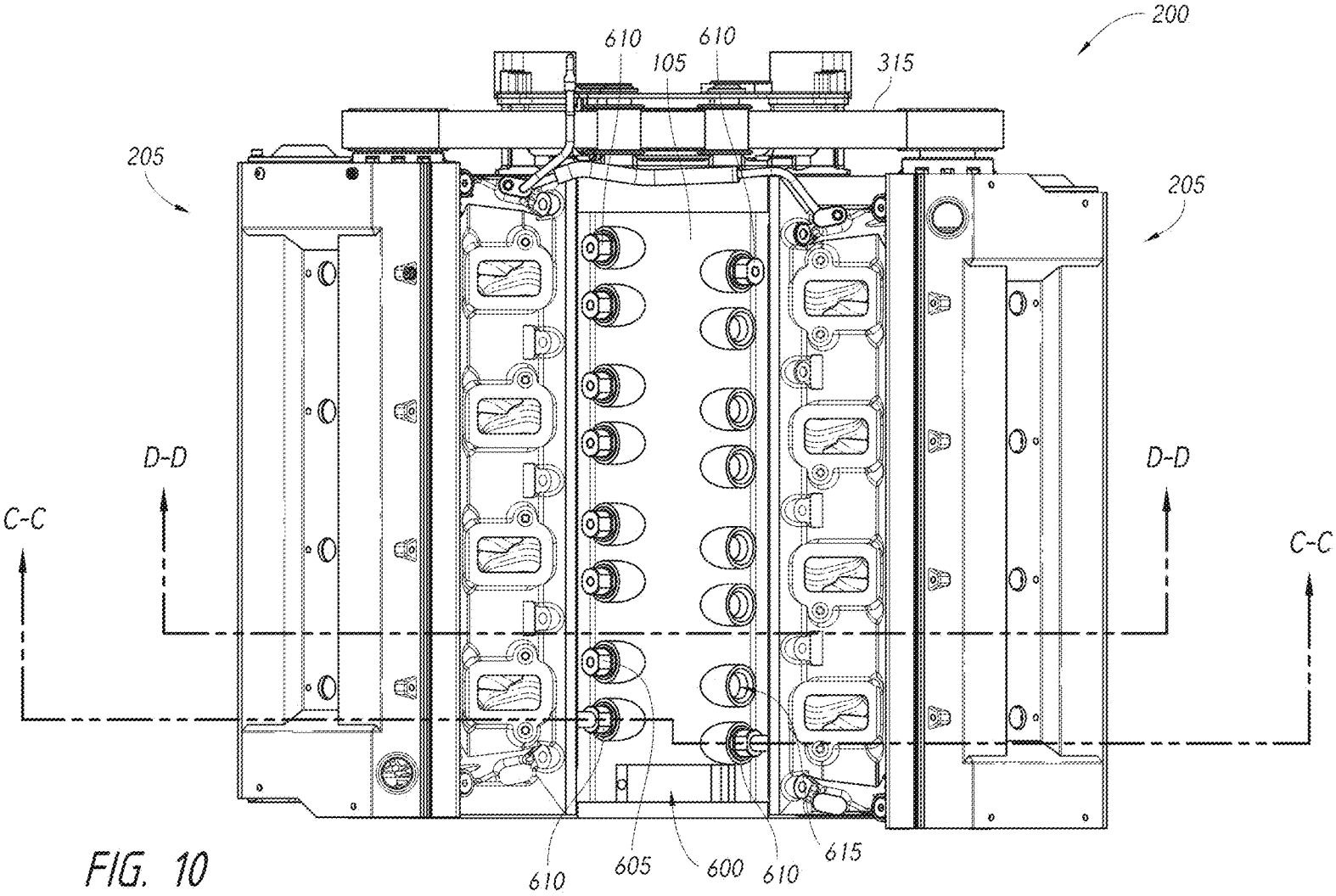
FIG. 10 illustrates a top elevation view of an embodiment of an oil feed system of an overhead camshaft valvetrain system.
Figure 11:
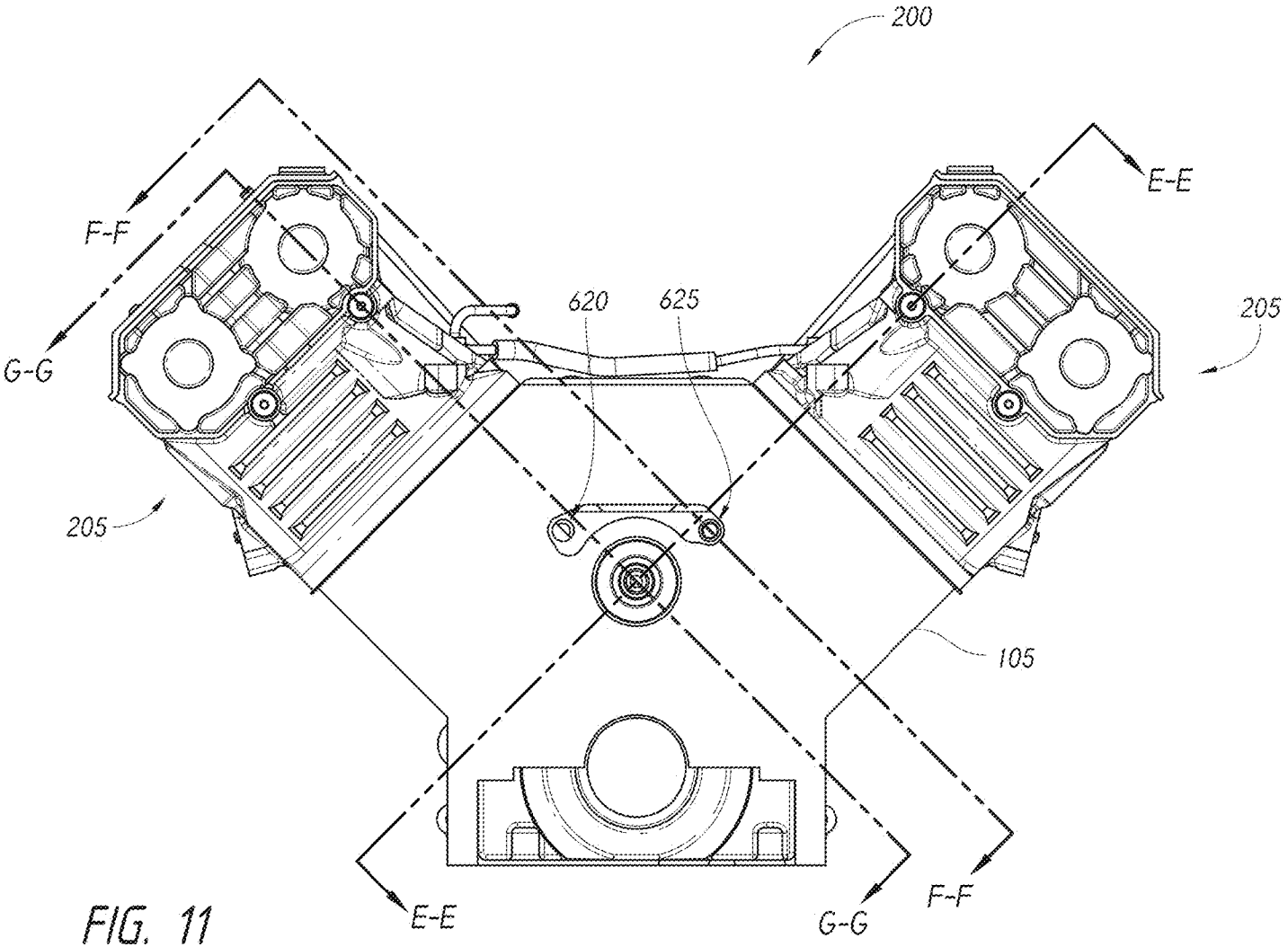
FIG. 11 illustrates a rear elevation view of the oil feed system of FIG. 10.

With reference first to FIGS. 10 and 11, the oil feed system 600 can include one or more fluid restrictor elements, such as the plugs 605, 610, placed within one or more existing passageways 615 for original valvetrain system components, such as lifters and/or pushrods. The one or more fluid restrictor elements can prevent or reduce flow past the fluid restrictor element. Moreover, while the fluid restrictor elements, such as the plugs 605, 610 can be separate units, as shown in the illustrated embodiments, the plugs can be connected together to form a monolithic unit. For purposes of this disclosure, it should be understood that fluid, such as oil, generally flows from the rear of the stock block 105 to the front of the stock block 105. In some embodiments, the fluid can generally flow from the front of the stock block 105 to the rear of the stock block 105. While the illustrated embodiment of the oil feed system 600 shows a configuration of fluid restrictor elements, such as the plugs 605, 610, other configurations are contemplated. One or more fluid restrictor elements can be positioned in one or more of the existing passageways 615. For example, in some embodiments, a fluid restrictor element, such as the plugs 605, 610, can be positioned in all of the existing passageways 615.

As shown in the illustrated embodiment, all of existing passageways 615 in fluid communication with the left oil galley 620 include the fluid restrictor elements, such as the plugs 605, 610, positioned therein. As also shown in the illustrated embodiment, only a front-most and a rear-most existing passageway 615 in fluid communication with the right oil galley 625 include a fluid restrictor element, such as the plugs 605, 610, positioned therein. It is contemplated that greater or fewer fluid restrictor elements can be used in existing passageways 615 in communication with the left and/or right oil galleys 620, 625. For example, in some embodiments, the plugs can be used in every existing passageway 615 in fluid communication with the right oil galley 625. Moreover, it is contemplated that, in some embodiments, one or more original valvetrain components, such as the lifters, can be maintained in one or more of the existing passageways 615. For example, the original lifters can be maintained in one or all of the existing passageways 615 that do not include a plug, such as certain of the existing passageways 615 in fluid communication with the right oil galley 625.

Figure 12:
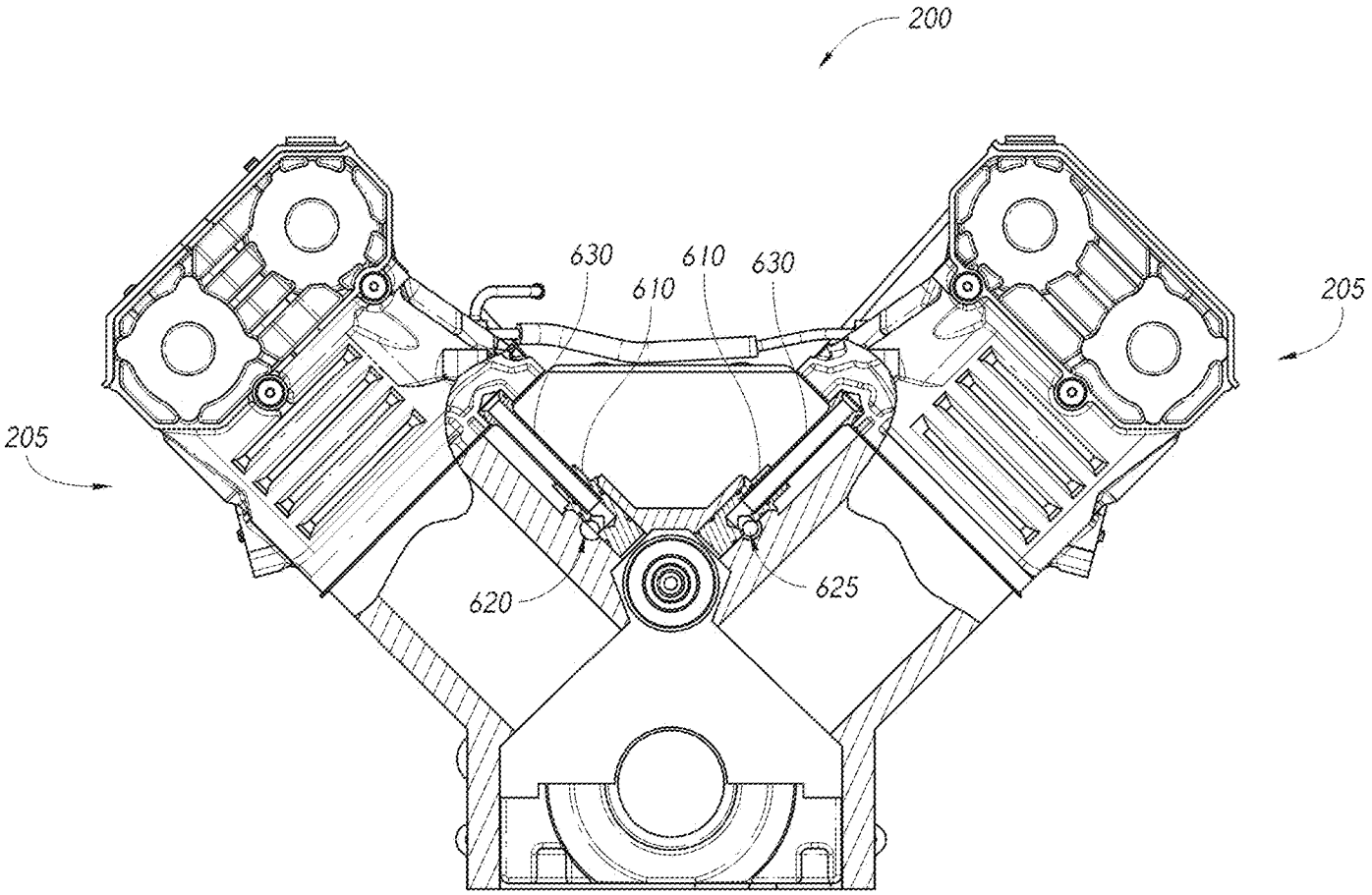
FIG. 12 illustrates a partial cross-sectional view of the oil feed system of FIG. 10 along line C-C.

With reference next to FIG. 12, as shown in the illustrated embodiment, the plugs 610 can include a fluid passageway 630, such as a tube attached to the plug 610, which can direct fluid flowing through the left and/or right oil galleys 620, 625 into the cylinder heads 205. Accordingly, the valvetrain system 200 can advantageously utilize the existing oil feed system of the existing engine 100 to supply oil to the cylinder heads 205. This can advantageously reduce the amount of time and work needed to convert the existing engine 100 from a "pushrod" or "I-head" valvetrain configuration to an overhead camshaft configuration. Moreover, since no permanent modification is made to the stock block 105, there is a reduced likelihood that the structural integrity of the stock block 105 could potentially be compromised.

Figure 13:
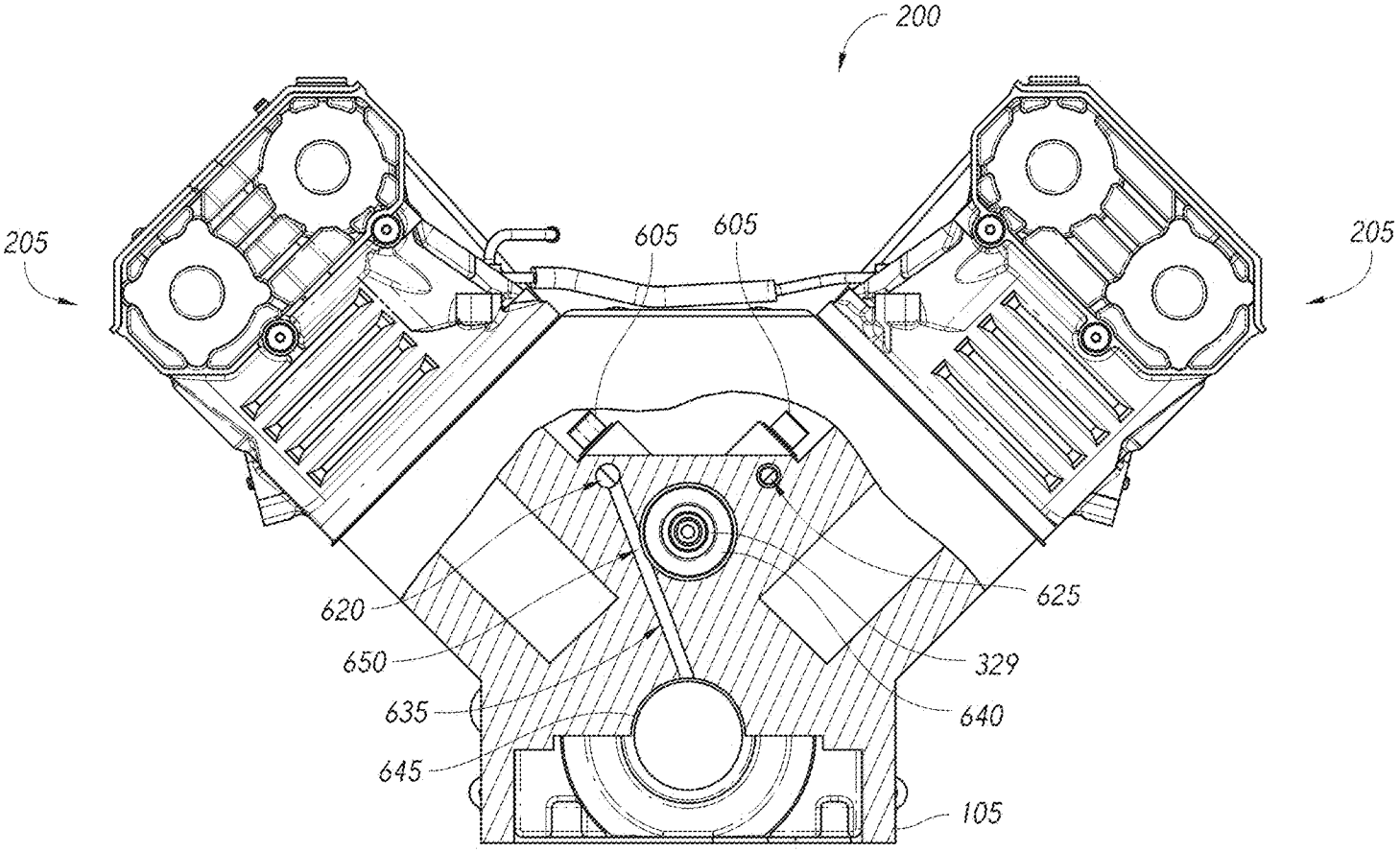
FIG. 13 illustrates a partial cross-sectional view of the oil feed system of FIG. 10 along line D-D.

With reference next to FIG. 13, as shown in the illustrated embodiment, the stock block 105 can include one or more existing bearing fluid passageways 635 to supply fluid bearings, such as a camshaft bearing 640 and/or crankshaft fluid bearing 645, with oil. For example, the existing bearing fluid passageways 635 can provide oil to the camshaft bearing 640 via a camshaft bearing port 650 to provide a fluid layer for the camshaft or dummy shaft 329. As shown in the illustrated embodiment, these bearing fluid passageways 635 can be in fluid communication with the left oil galley 620, although it is also contemplated that the bearing fluid passageways 635 could also be in fluid communication with the right oil galley 625 or solely in fluid communication with the right oil galley 625. Accordingly, in some embodiments, fluid flow through the oil galleys in fluid communication with the bearing fluid passageways 635, such as the left oil galley 620, can be maintained throughout a portion, or the entirety, of the length of the galley. In some embodiments, fluid flow through the galley in fluid communication with the bearing fluid passageways 635 can be maintained throughout at least one-fourth of the length of the galley, at least one-half of the length of the galley, at least 75% of the length of the galley, at least until the final bearing fluid passageway 635 of the galley, or any other portion of the length of the galley, as desired.

Figure 14:
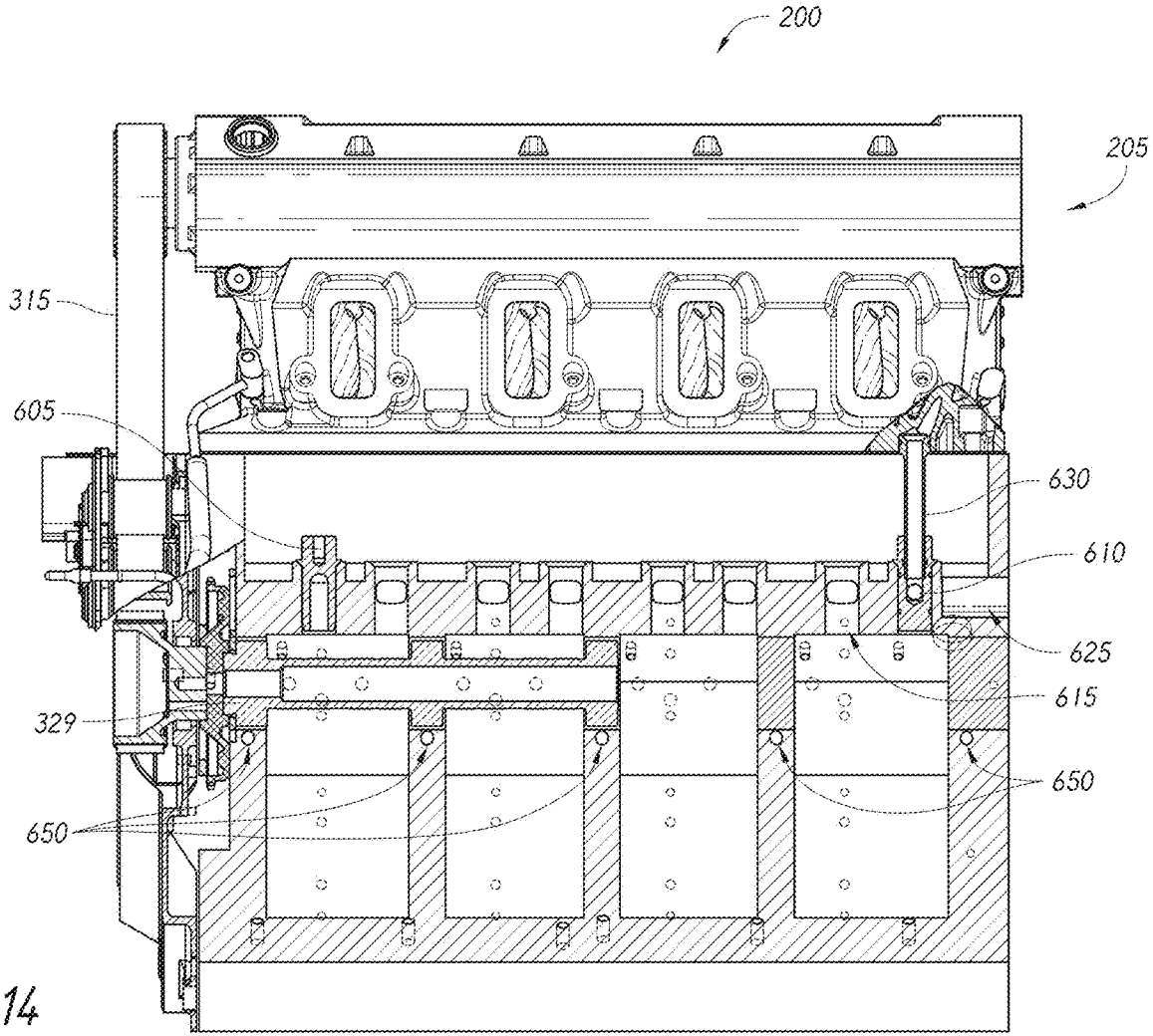
FIG. 14 illustrates a partial cross-sectional view of the oil feed system of FIG. 11 along line E-E.
Figure 15:
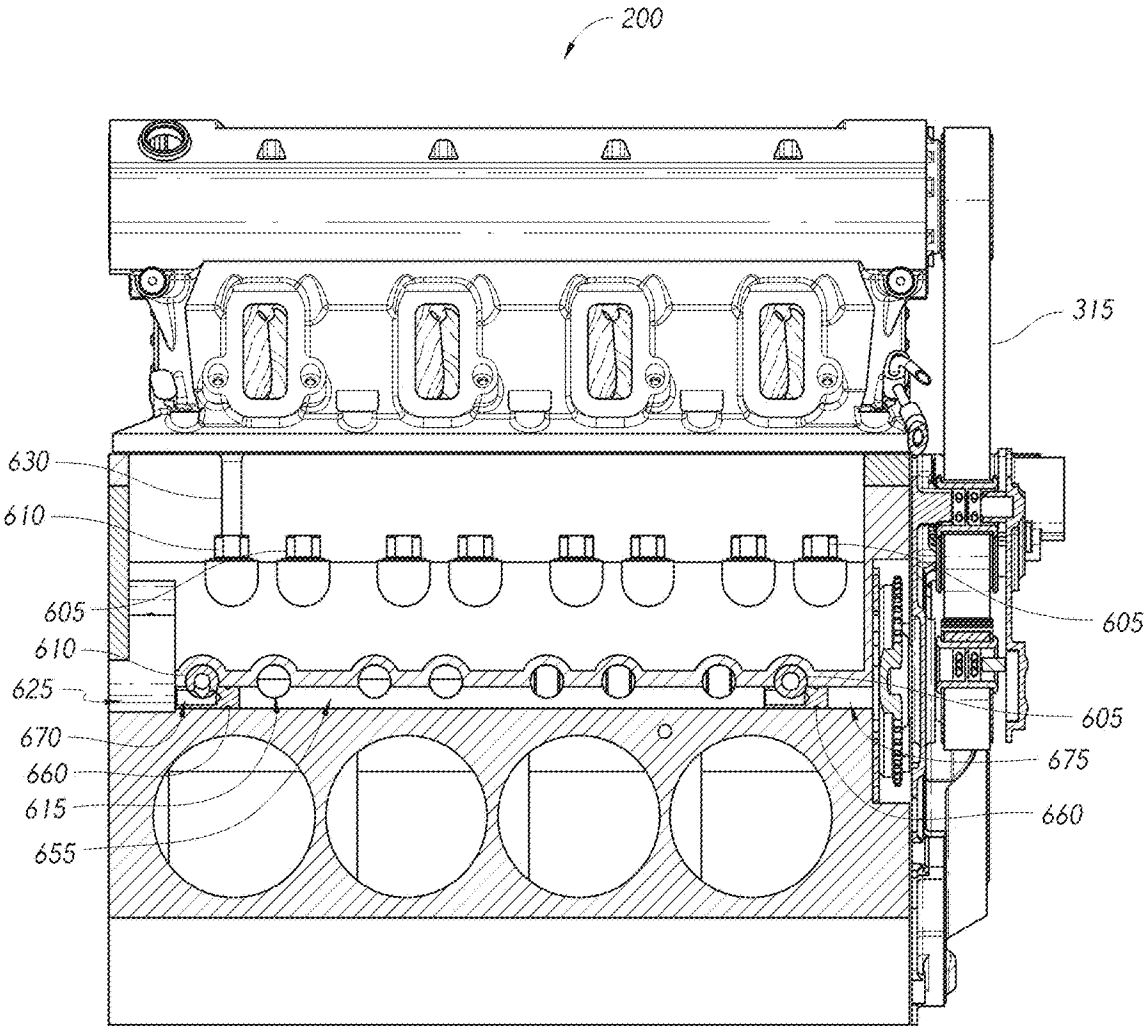
FIG. 15 illustrates a partial cross-sectional view of the oil feed system of FIG. 11 along line F-F.

With reference next to FIGS. 14 and 15, as shown in the illustrated embodiment, a rear plug 610 can be positioned at the rear-most existing passageway 615 in fluid communication with the right oil galley 625 and a front plug 605 can be positioned at the front-most existing passageway 615 in fluid communication with the right oil galley 625. It is also contemplated that the plug 610 can be positioned in any other existing passageways 615, such as the front-most existing passageway 615 and the plug 605 can be positioned in any other existing passageways 615, such as the rear-most existing passageway.

In some embodiments, a fluid restrictor element, such as the plug 660, can be positioned within the right oil galley 625 at or near a location of the rear plug 610. The plug which can prevent or reduce fluid flow into a portion 665 of the right oil galley 625, thereby potentially eliminating the need for additional fluid restrictor elements within the existing passageways 615 in communication with the portion 665 of the right oil galley 625. The plug 660 can include a flow pathway 670 in fluid communication with a flow pathway of the plug 610 to supply oil to the plug 610 and into the cylinder head 205. A second plug 660 can be positioned within the right oil galley 625 at or near a location of the front plug 610, which can prevent or reduce fluid backflow from a portion 675 of the right oil galley 625 into the portion 665 of the right oil galley 625.

Fewer or greater numbers of the plugs 660 can be positioned within the left and/or right oil galleys 620, 625. Moreover, the plugs 660 can be positioned at any other location within the left and/or right oil galleys 620, 625, such as at any of the existing passageways 615, between the existing passageways 615, and/or a combination of these locations.

Figure 16:
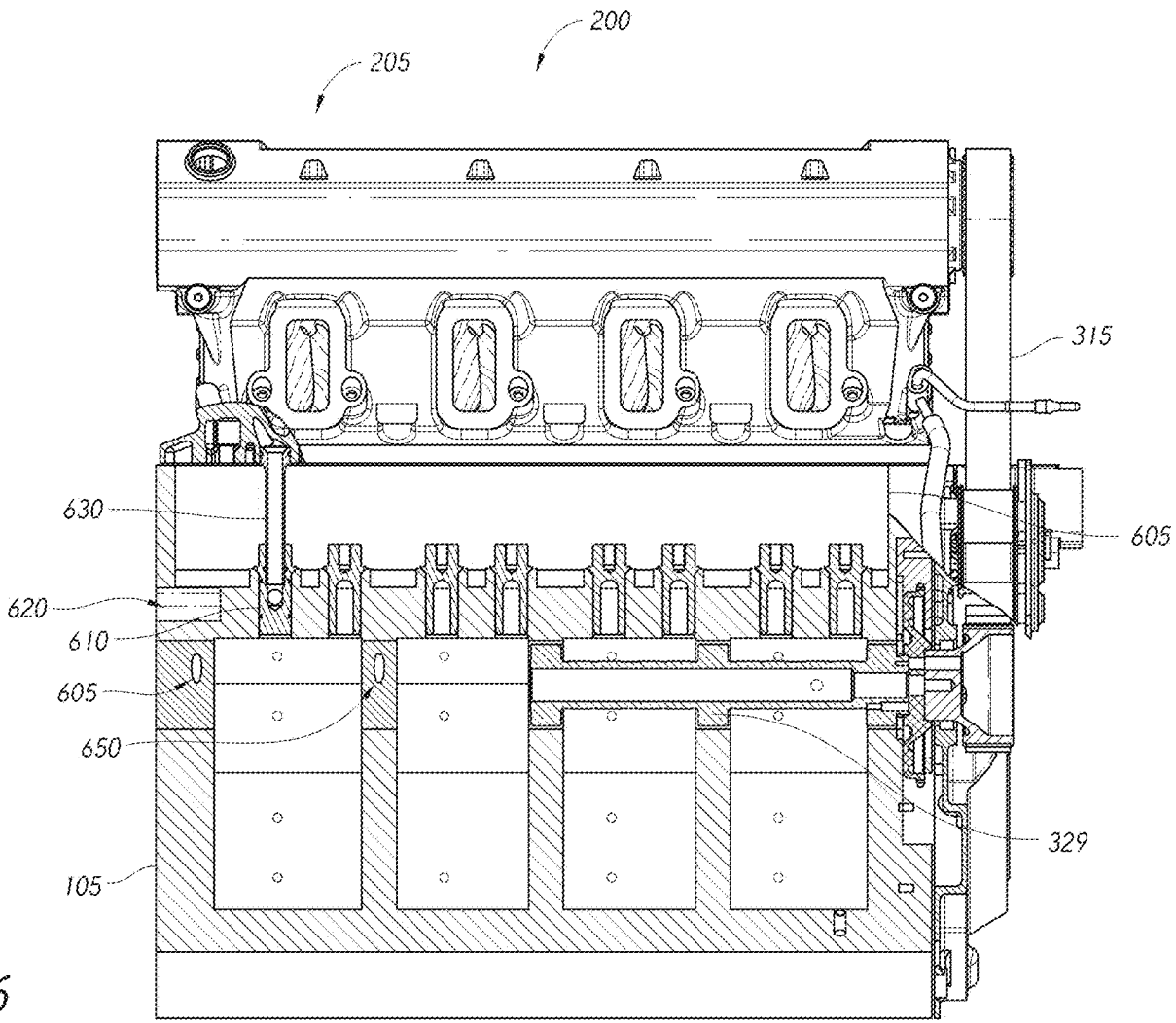
FIG. 16 illustrates a partial cross-sectional view of the oil feed system of FIG. 11 along line G-G.
Figure 17:
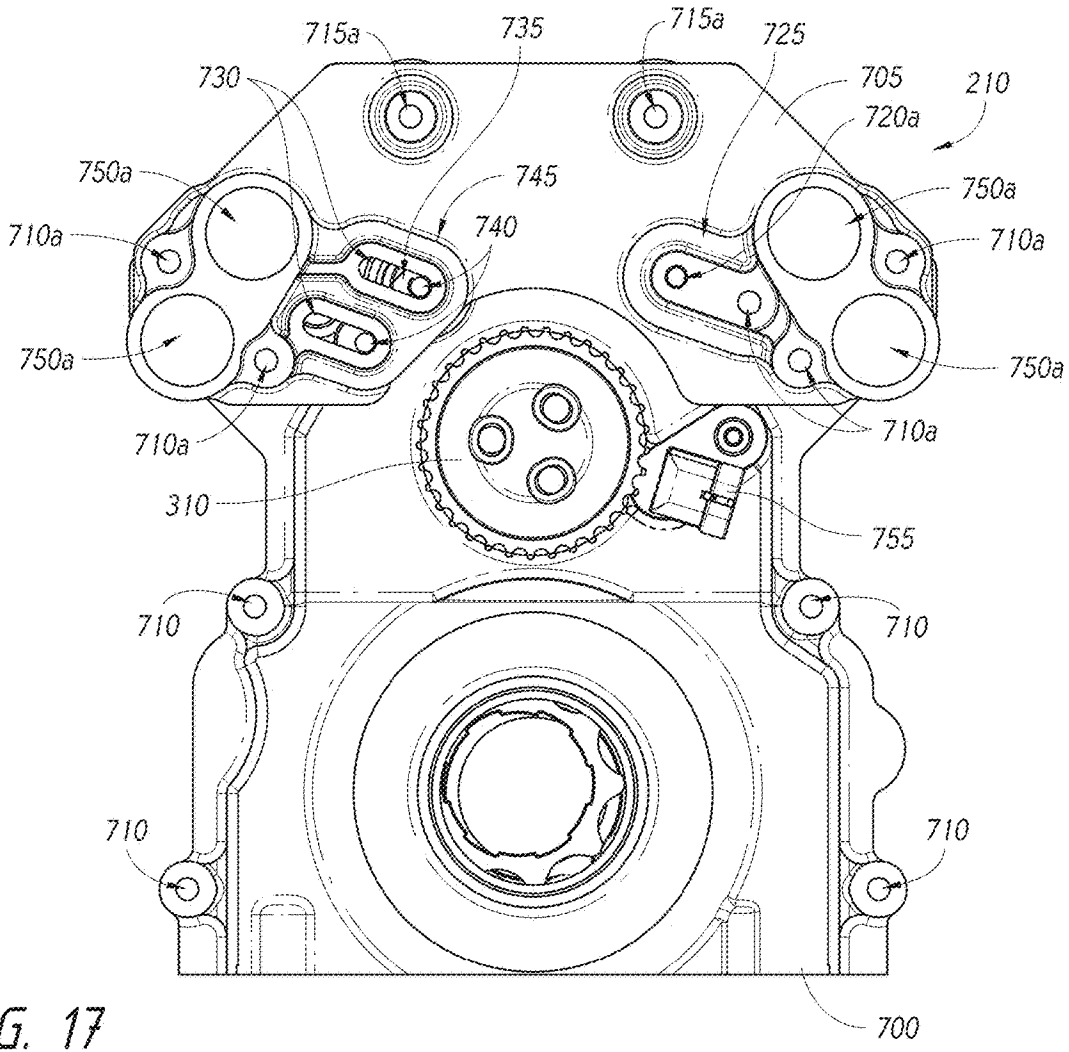
FIG. 17 illustrates a front elevation view of an embodiment of a cover and components of an overhead camshaft valvetrain system.
Figure 19:
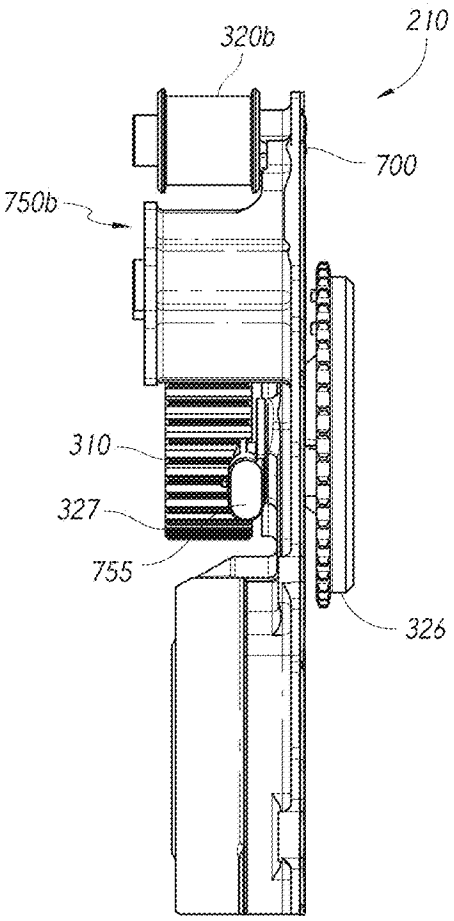
FIG. 19 illustrates a left side elevation view of the cover and components of FIG. 17 with a front portion removed.
Figure 18:
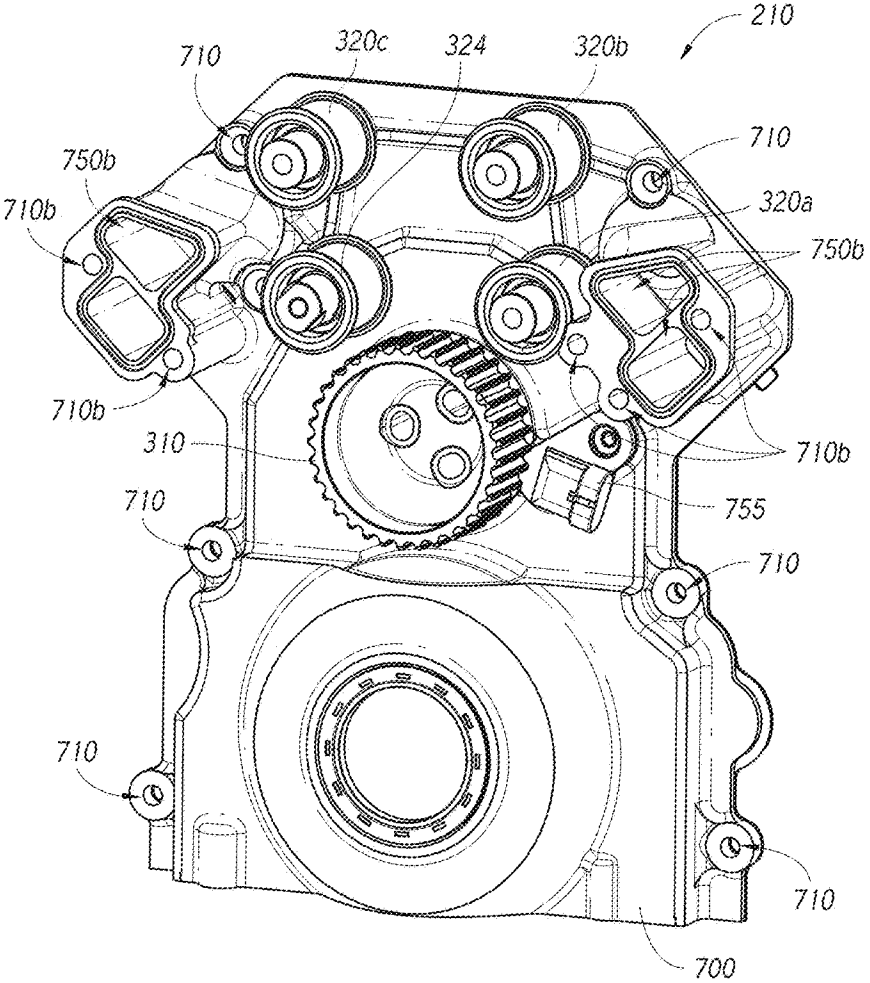
FIG. 18 illustrates a front perspective view of the cover and components of FIG. 17 with a front portion removed.
Figure 20:
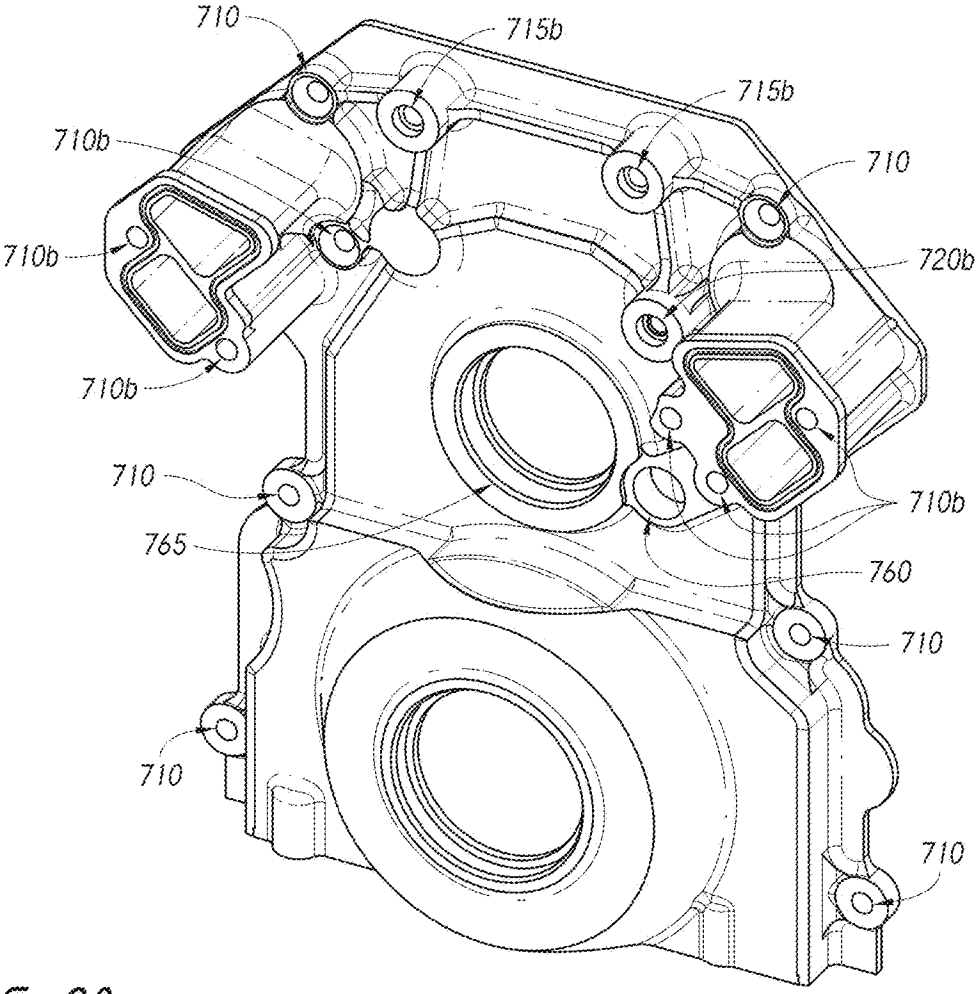
FIG. 20 illustrates a front perspective view of the cover of FIG. 17 with a front portion and components removed.
Figure 21A:
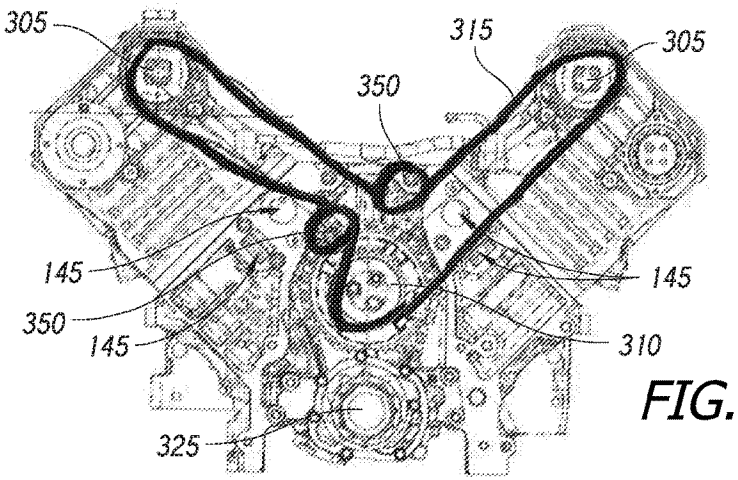
FIGS. 21A-21G illustrate schematic views of various configurations of guide members and a single flexible transmitter coupled to an intermediate gear.
Figure 21B:
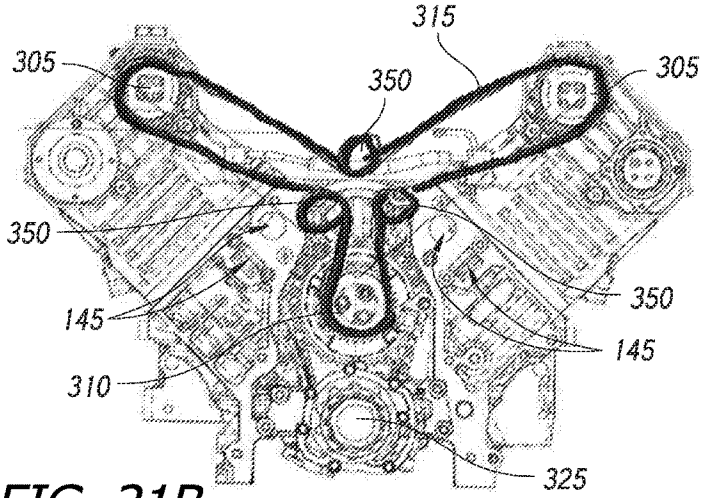
Figure 21C:
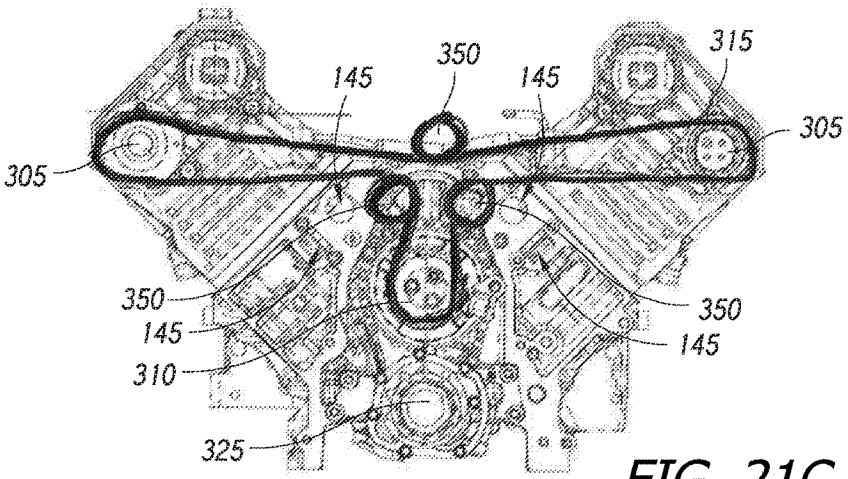
Figure 21E:
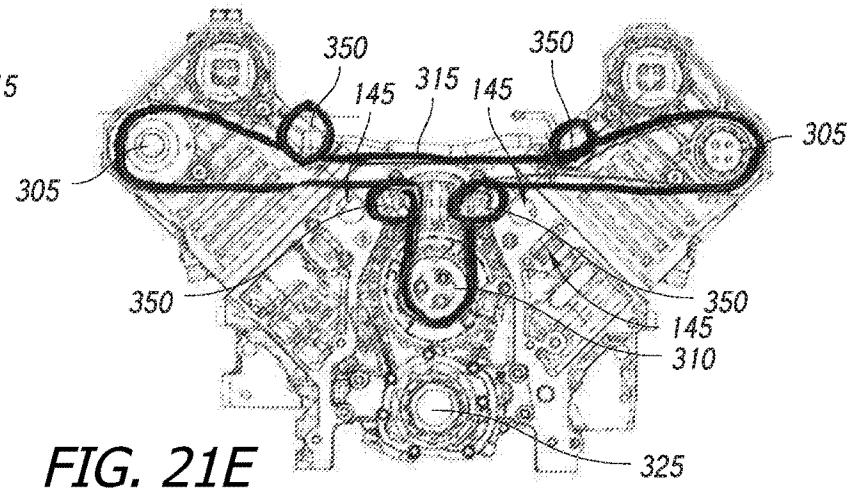
Figure 21D:
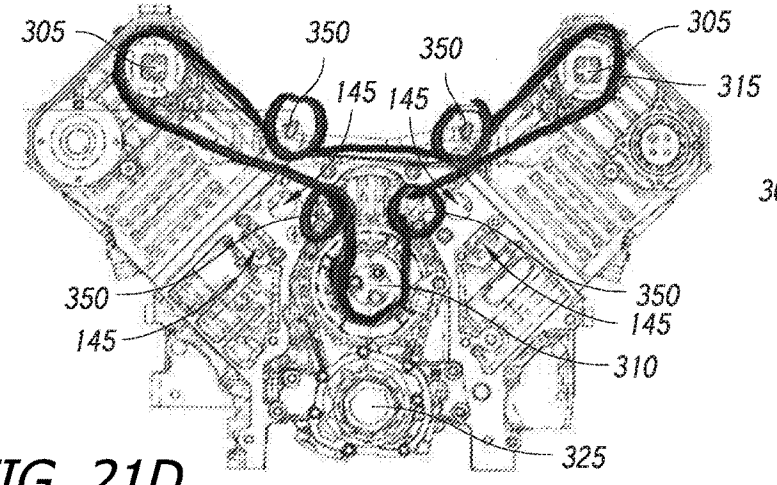
Figure 21G:
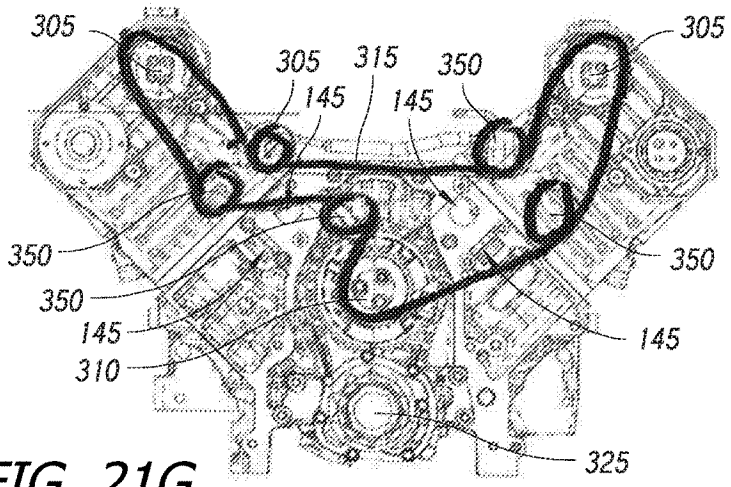
Figure 21F:
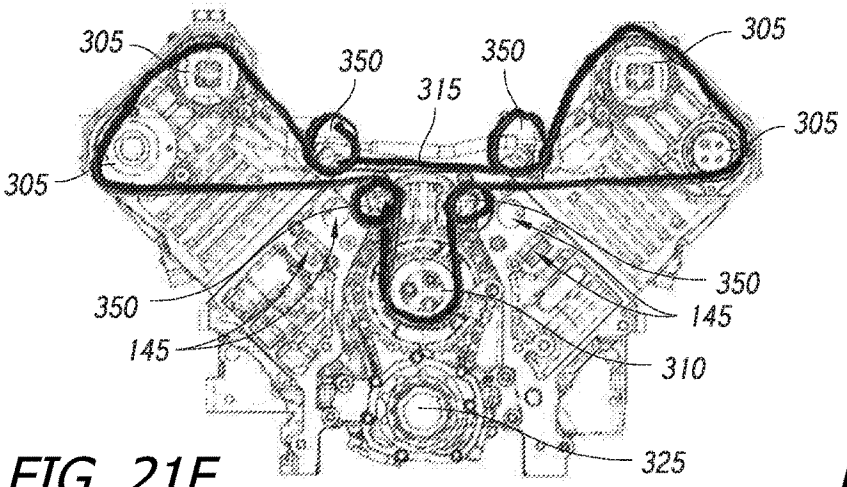
Figure 22A:
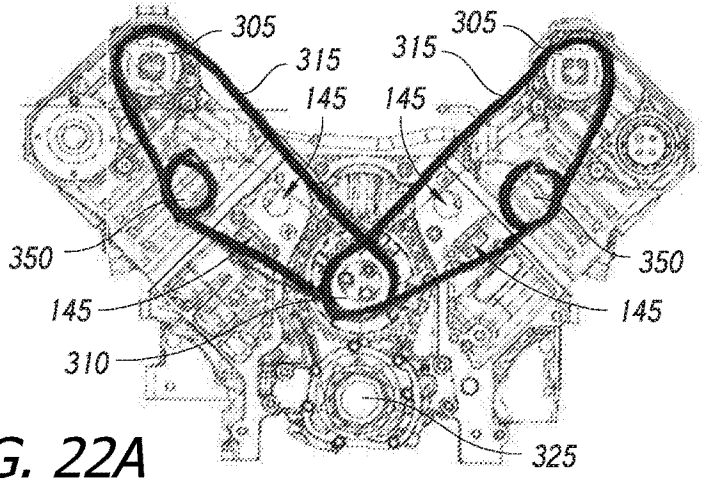
FIGS. 22A-22K illustrate schematic views of various configurations of guide members and two flexible transmitters coupled to an intermediate gear.
Figure 22B:
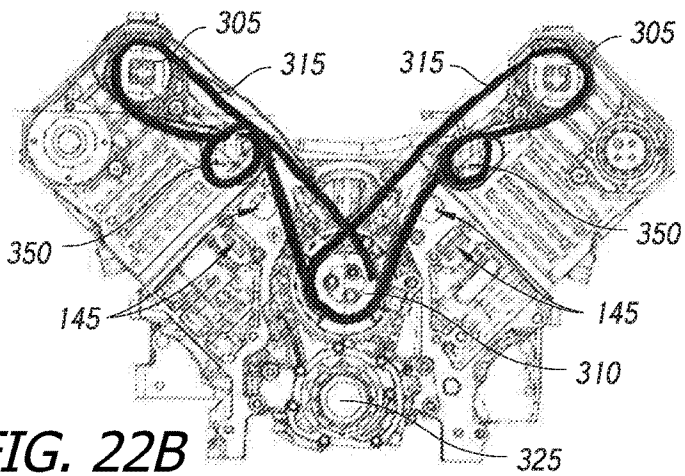
Figure 22C:
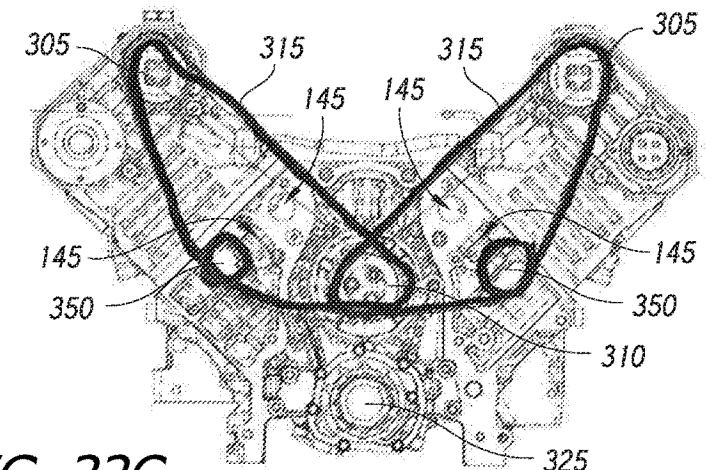
Figure 22D:
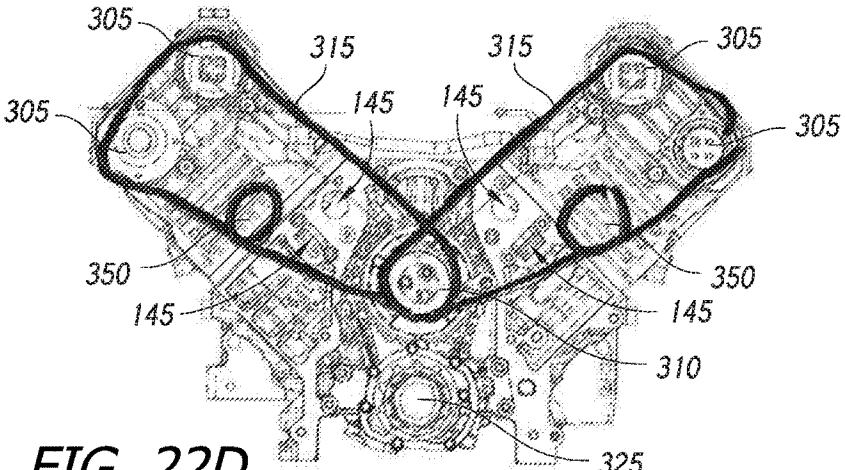
Figure 22F:
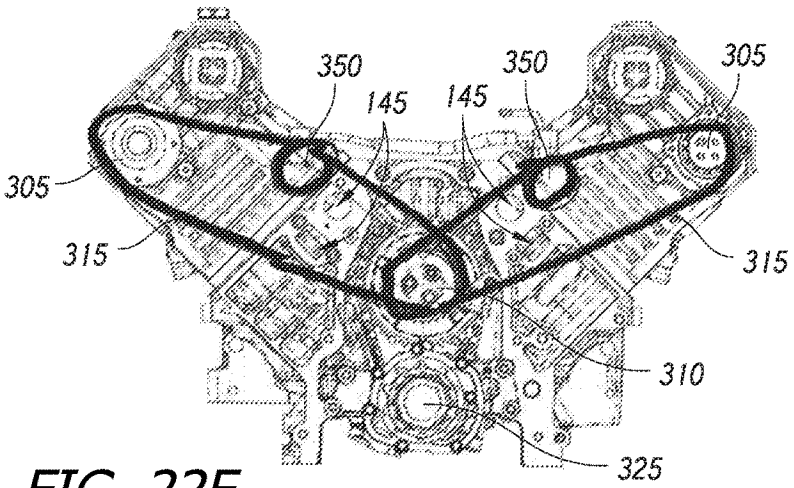
Figure 22E:
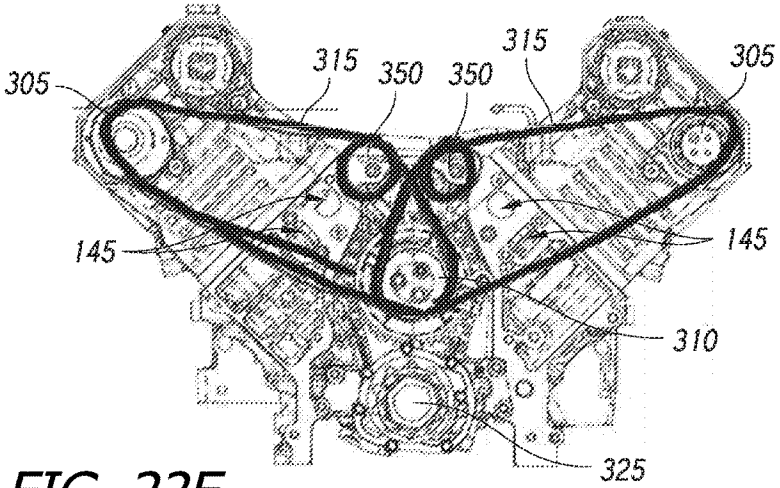
Figure 22G:
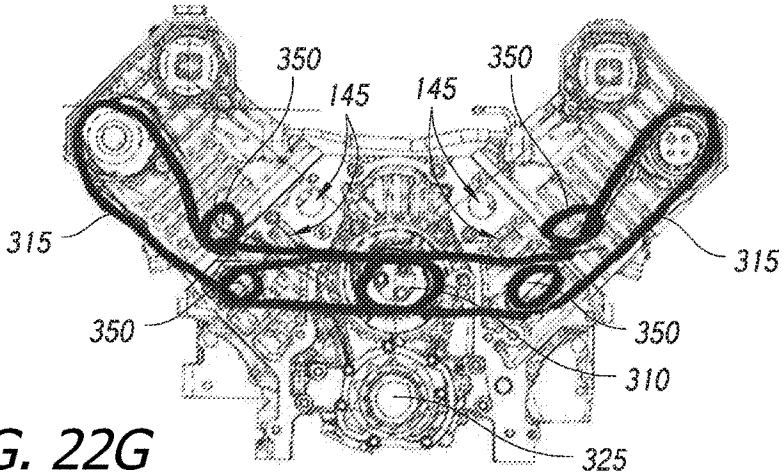
Figure 22H:
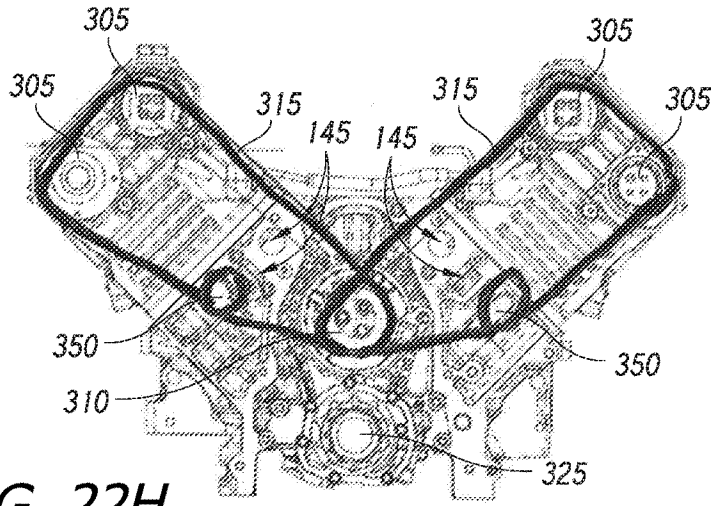
Figure 22J:
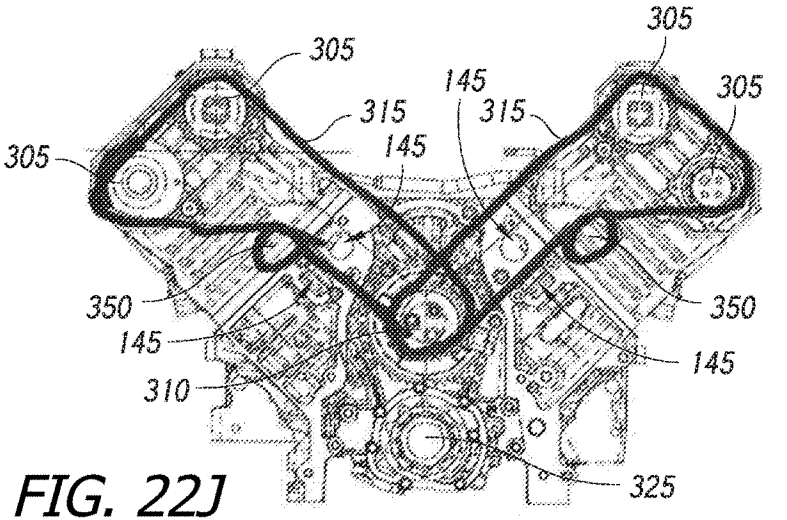
Figure 22I:
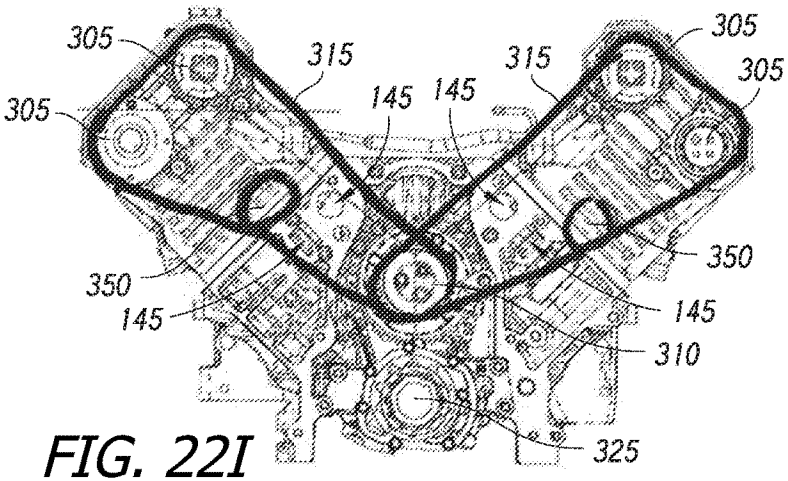
Figure 22K:
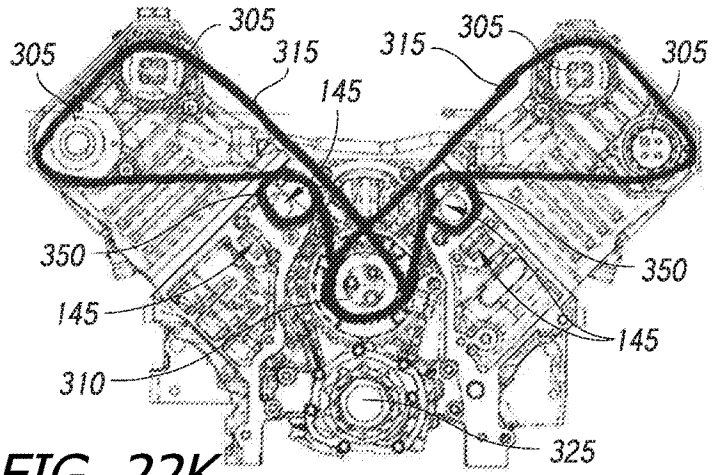
Figure 23A:
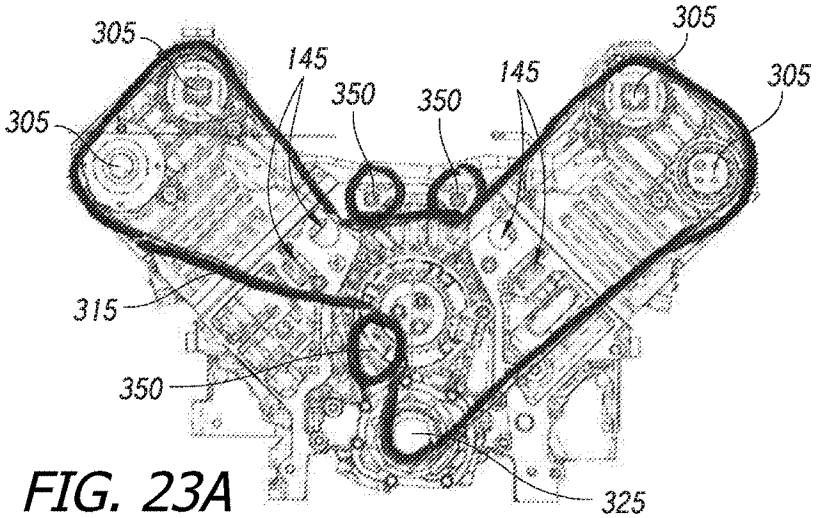
FIGS. 23A-23F illustrate schematic views of various configurations of guide members and flexible transmitters coupled to a crankshaft gear.
Figure 23B:
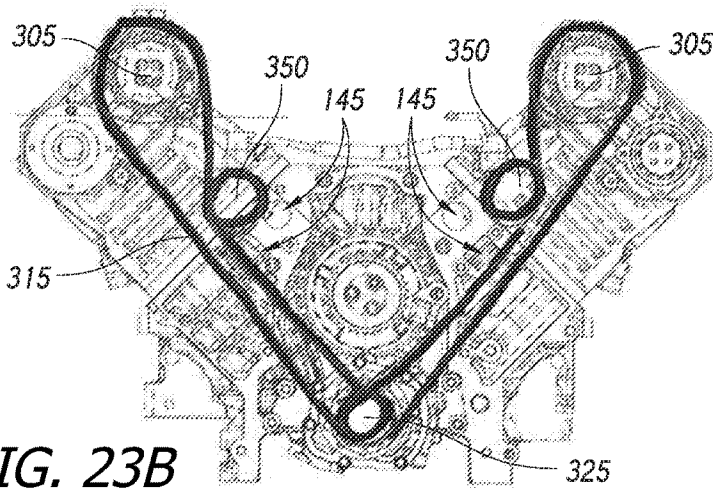
Figure 23C:
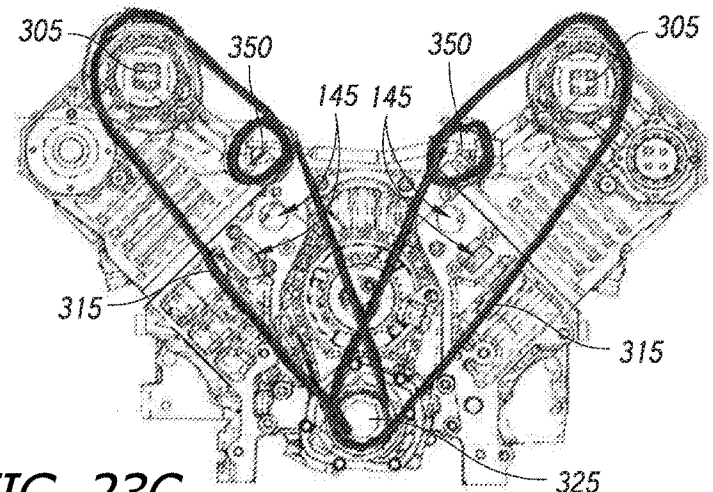
Figure 23D:
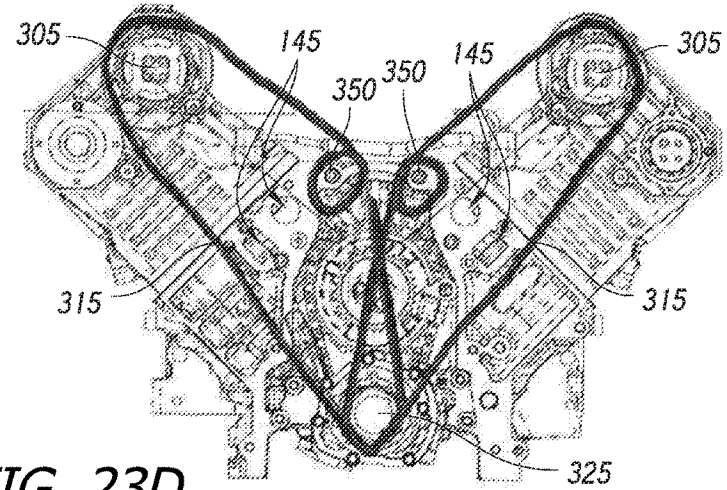
Figure 23F:
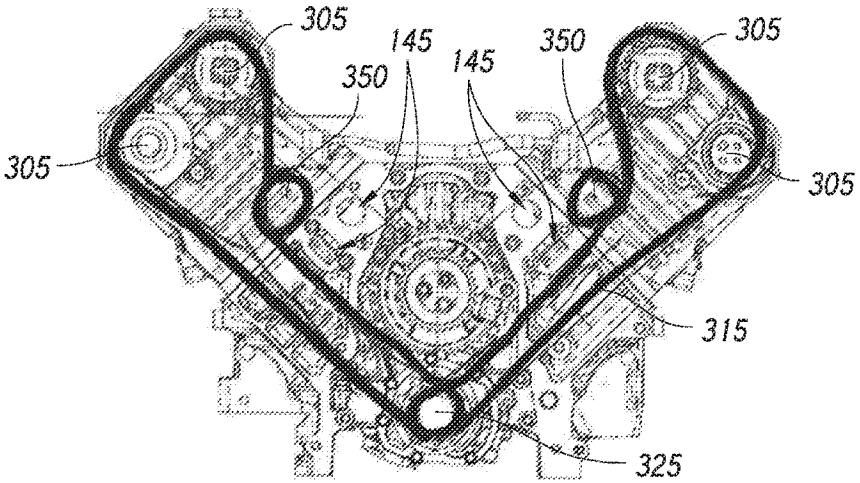
Figure 23E:
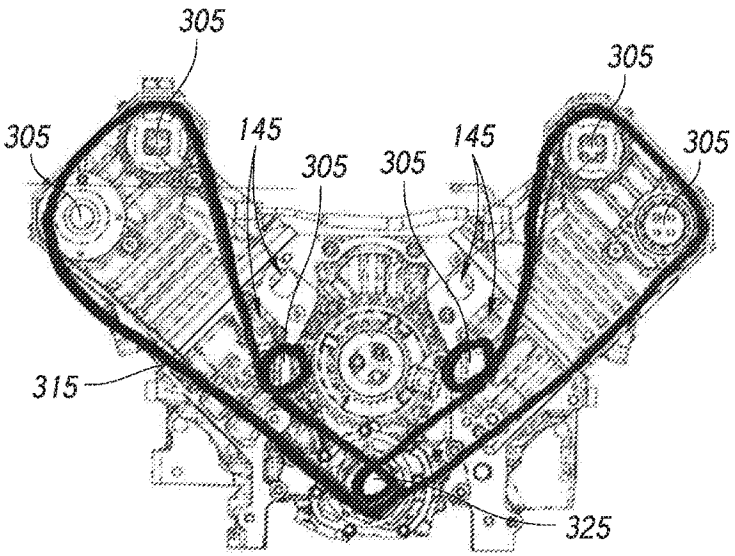

With reference next to FIG. 16, as shown in the illustrated embodiment, a rear plug 610 can be positioned at the rear-most existing passageway 615 in fluid communication with the left oil galley 620 and a front plug 605 can be positioned at the front-most existing passageway 615 in fluid communication with the left oil galley 620. It is also contemplated that the plug 610 can be positioned in any other existing passageways 615, such as the front-most existing passageway 615. This can advantageously allow the bearing fluid passageways 635 to receive oil from the left oil galley 620 prior to delivery of oil to the cylinder head 205 from the left oil galley 620. In the illustrated embodiment, no fluid restrictor elements are positioned within the left oil galley 620 to prevent or reduce fluid flow through the left oil galley 620. In this manner, oil can flow throughout the entirety of the left oil galley 620 and flow into bearing fluid passageways 635.

In some embodiments where the stock camshaft is removed from the existing engine 100, pressure drops may occur due to unimpeded flow through camshaft bearing port 650. In some embodiments, this pressure drop can be reduced by utilizing the dummy shaft 329 that covers one or more of the camshaft bearing ports 650. In some embodiments, this pressure drop can be reduced by rotating one or more camshaft bearings 640 to block one or more camshaft bearing ports 650. In some embodiments, this pressure drop can be reduced by plugging the camshaft bearing ports 650 with a plug. It is also contemplated that the camshaft of the existing engine 100 can be left in place.

In the illustrated embodiment, separate plugs 610 with fluid passageways 630 are used to provide oil to the left and right oil galleys 620, 625. It is also contemplated that a single plug 610, having a branched fluid passageway, can be used to supply oil to both the left and right oil galleys 620, 625 from a single existing passageway 615. For example, a single plug 610 having a branched fluid passageway can be used in an existing passageway 615 in fluid communication with the right oil galley 625 to provide oil to both the left and right side cylinder heads 205. This can beneficially allow the left side oil galley 620 to be used primarily for providing oil to the bearing fluid passageways 635. In some embodiments, plugs 605 can be used in all existing passageways 615 and oil can be provided to one or both cylinder heads 205 externally.

Cover

FIGS. 17-20 illustrate an embodiment of a cover 210 of the valvetrain system 200. The cover 210 can be attached to a front side 130 of the stock block 105 (as shown in FIGS. 2 and 3) of the existing engine 100 to cover internal components of the existing engine 100. Moreover, the cover 210 can provide mounting points for additional components of the valvetrain system 200.

As shown in the illustrated embodiment, the cover 210 can include a rear portion 700 and a front portion 705 axially spaced from the rear portion 700 such that a cavity or space is formed between the rear portion 700 and the front portion 705. As shown in the illustrated embodiment, the rear portion 700 and the front portion 705 can be formed as two separate units that can be attached together using mechanical fasteners, such as screws. It is also contemplated that the two portions 700, 705 can be attached together using one or more chemical fasteners, such as an adhesive, and/or through processes, such as welding. In some embodiments, the rear portion 700 and the front portion 705 can be formed as a monolithic unit.

As shown in the illustrated embodiment, the cover 210 can include one or more holes, such as the holes 710, 710*b*, 715*b* positioned on the rear portion 700, and holes 710*a*, 715*a* on the front portion 705, which can be arranged such that the cover 210 can be attached to one or more existing fastener holes 150 of the stock block 105. In some embodiments, the cover 210 can include a plurality of fastener holes that correspond to all existing fastener holes 150 of the stock block 105. In this manner, the cover 210 can beneficially take advantage of the structural integrity of the stock block 105.

The cover 210 can be designed to serve as a mount for various components of the overhead camshaft valvetrain system 200, such as one or more guide members. As shown in the illustrated embodiment, the cover 210 can include one or more mounting locations, such as holes 715*a*, 715*b* that are arranged such that one or more mounts for the guide members, such as the idler pulleys 320*b*, 320*c*, can be attached directly to one or more existing fastener holes 150 of the stock block 105. In some embodiments, the mount for the guide member can be a fastener used to attach the cover 210 to the stock block 105. Accordingly, the guide members mounted at this location can advantageously benefit from the existing structural integrity of the stock block 105. While the illustrated embodiment shows two mounting locations that are arranged such that two mounts can be attached directly to two existing fastener holes 150, it is contemplated that fewer or greater than two of such mounting locations can be provided. For example, any of holes 710, 710*a*, 710*b*, 715*a*, and/or 715*b* can be a mounting location for components of the valvetrain system 200, such as the guide members.

As shown in the illustrated embodiment, the cover 210 can include one or more mounting locations, such as the holes 720*a*, 720*b*, that are arranged such that one or more mounts for the guide members, such as the idler pulley 320*a*, are not directly attached to one or more existing fastener holes 150 of the stock block 105. In some embodiments, the mount for the guide member can be a fastener attached to the rear portion 700 of the cover 210. This can advantageously allow mounting of components of the valvetrain system 200 at locations where an existing fastener hole 150 does not exist. In some embodiments, to strengthen these mounting locations for guide members, such as the idler pulley 320*a*, the cover member can include a rib 725 or other structural enhancement. While the illustrated embodiment shows one such mounting location, it is contemplated that greater than one of such mounting locations can be provided on the cover 210.

As shown in the illustrated embodiment, the cover 210 can include one or more mounting locations, such as slots 730, that are arranged such that one or more mounts for the guide members, such as the tensioner pulley 324, are moveable relative to the cover 210. The slots 730 can be shaped to provide a linear or generally linear guide path along which the guide member can travel. This can advantageously maintain clearance between the flexible transmitter, such as the flexible transmitter 315, with other components, such as other portions of the flexible transmitter, other guide members, water passages, and/or other engine components. Other non-linear guide paths are contemplated, including radial paths. In the illustrated embodiment, the slots 730 can provide a guide path which is parallel to the flexible transmitter path of the flexible transmitter 315. The guide member can be mounted to this mounting location using a mounting plate 735 and fasteners passing through holes 740 of the mounting plate such that the fasteners are restricted to movement along the guide path defined by the slots 730. A biasing member (not shown) can be used to bias the tensioner pulley 324 towards a location which would tension the flexible transmitter 315. In some embodiments, to strengthen these mounting locations for the guide members, such as the tensioner pulley 324, the cover member can include a rib 745 or other structural enhancement. While the illustrated embodiment shows one movable mounting location, it is contemplated that greater than one of the movable mounting locations can be provided on the cover 210. For example, in embodiments having multiple flexible transmitters, it can be advantageous to have two or more movable mounting locations for guide members designed to tension the flexible transmitters.

As shown in the illustrated embodiment, the cover 210 can include one or more fluid passages having ports, 750*a*, 750*b* that can be fluidically coupled to one or more existing apertures 145 of the stock block 105. The fluid passages can be integrally formed with the cover 210 or separate from the cover 210. For example, as noted above, the one or more existing apertures 145 can be in communication with fluid passageways for coolant. The one or more ports 750*a*, 750*b* can project outwardly from the rear portion 700 and/or the front portion 705 of the cover 210. As shown in the illustrated embodiment, the ports 750*a* have a circular shape to facilitate connection with cylindrical hoses; however, it is also contemplated that one or more of the ports 750*a* can have other non-circular shapes, including but not limited to polygonal shapes. For example, port 750*b* is non-circular and is in fluid communication with a non-circular passageway through the projection. The non-circular passageway can provide additional clearance for the flexible transmitters, such as the flexible transmitter 315.

As shown in the illustrated embodiment, the cover 210 can include a mounting location 760 for a cam position sensor 755. In some embodiments, the mounting location 760 for the cam position sensor 755 can be at the same radial and/or axial location as compared to the original position for this sensor. In some embodiments, the mounting location of 760 for the cam position sensor 755 can be at the same radial distance as compared to the original position for this sensor and located axially to be used in conjunction with gear 326. This can advantageously allow a user of the valvetrain system 200 to utilize the original cam position sensor 755. Moreover, this can reduce the amount of reprogramming, if any, of the existing engine's 105 computer control system. In some embodiments, the original cam position sensor 755 can be used with the original camshaft gear supplied with the existing engine 100. As shown in the illustrated embodiment, the cover 210 can include a mounting location 765, for an intermediate gear 310. In some embodiments, the mounting location 765 can seal the intermediate gear 310 to the cover 210 and/or can include an element, such as a bearing, to seal the intermediate gear 310 to the cover 210. In some embodiments, the cover 210 can be designed such that the original oil seal from the existing engine 100 can be used with the cover 210.

Kits

In some embodiments, one or more of the components discussed above can be provided and/or sold as part of a kit.

In some embodiments, the kit can include a head assembly having one or more overhead cam cylinder heads, such as the cylinder head 205, one or more valve and end covers, one or more camshafts such as the intake camshaft 400 and/or exhaust camshaft 410, one or more a camshaft bridges, one or more valves, such as the intake valves 405 and/or the exhaust valves 415, one or more spring and valve seats, one or more guides, one or more gears and/or sprockets, one or more flexible transmitters, such as the flexible transmitter 315, one or more motion converters, such as the finger followers 420, one or more adjustment mechanisms, such as lash adjusters discussed in connection with the adjustment mechanism 430, one or more biasing mechanisms, such as the valve springs discussed in connection with the biasing mechanisms 425, one or more plugs, such as the plugs 605, 610, 660, one or more locks, one or more retainers, one or more fasteners, and/or one or more seals.

In some embodiments, the kit can include a transmission system having one or more gears and/or sprockets, such as the camshaft gear 305, the intermediate gear 310, and/or the crankshaft gear 325, one or more stationary guide members, such as the idlers pulleys 320*a*, 320*b*, 320*c*, one or more adjustable guide members, such as the tensioner pulley 324, one or more covers, such as the cover 210, one or more intermediate shaft thrust plate, one or more bearings, one or more flexible transmitters, such as the flexible transmitter 315, one or more fasteners, and/or one or more seals.

In some embodiments, the kit can include an oil feed system having one or more fluid restrictor elements for use within an existing passageway for a valvetrain component, such as the plugs 605, 610, one or more oil feed tubes, such as the plugs 610 having the fluid passageway 630, one or more fluid restrictor elements for use within a galley, such as the plugs 660, and/or one or more seals.

OTHER EMBODIMENTS

Any value of a threshold, limit, duration, etc. provided herein is not intended to be absolute and, thereby, can be approximate. In addition, any threshold, limit, duration, etc. provided herein can be fixed or varied either automatically or by a user. Furthermore, as is used herein relative terminology such as exceeds, greater than, less than, etc. in relation to a reference value is intended to also encompass being equal to the reference value. For example, exceeding a reference value that is positive can encompass being equal to or greater than the reference value. In addition, as is used herein relative terminology such as exceeds, greater than, less than, etc. in relation to a reference value is intended to also encompass an inverse of the disclosed relationship, such as below, less than, greater than, etc. in relations to the reference value.

While certain embodiments have been described, these embodiments have been presented by way of example only, and are not intended to limit the scope of the disclosure. Indeed, the novel devices, system and methods described herein may be embodied in a variety of other forms. Furthermore, various omissions, substitutions and changes in the systems and methods described herein may be made. The accompanying claims and their equivalents are intended to cover such forms or modifications as would fall within the scope of the disclosure. Accordingly, the scope of the present disclosure is defined only by reference to the claims presented herein or as presented in the future.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

What is claimed is:

1. An overhead camshaft valvetrain system for use with an existing engine, the existing engine having at least a cam-in-block engine block, the overhead camshaft valvetrain system comprising:

a first and second cylinder head each comprising an overhead valvetrain system comprising at least one overhead camshaft, at least one valve, and at least one motion converter configured to convert rotational motion of the at least one overhead camshaft into translational motion, the at least one overhead camshaft configured to actuate the at least one valve via the at least one motion converter, wherein the first and second cylinder heads are fastened to the cam-in-block engine block; and a transmission system which operably couples the at least one overhead camshaft to a crankshaft of the existing engine, the transmission system comprising at least one flexible transmitter, wherein the transmission system is configured to transfer rotational motion of the crankshaft of the existing engine to the at least one overhead camshaft;

wherein the existing engine is an engine from the Chevrolet LS family, and wherein the first cylinder head, the second cylinder head, and the transmission system can be retrofitted onto the existing cam-in-block engine block without modification.

2. The overhead camshaft valvetrain system of claim 1, wherein the at least one flexible transmitter comprises at least one of a belt and a chain.

3. The overhead camshaft valvetrain system of claim 2, wherein the transmission system further comprises an intermediate gear operably coupled to the crankshaft of the existing engine, wherein at least a first flexible transmitter couples the intermediate gear to the at least one overhead camshaft.

4. The overhead camshaft valvetrain system of claim 3, wherein the intermediate gear comprises:

a first portion comprising a first plurality of engagement members and an indexed surface, the first plurality of engagement members configured to operably couple with the crankshaft of the existing engine, the indexed surface comprising a plurality of raised and recessed portions;

a second portion axially spaced from the first portion, the second portion comprising a second plurality of engagement members for coupling at least the first flexible transmitter to the second portion; and a projection extending between the first portion and the second portion and oriented generally perpendicular to the indexed surface;

wherein the plurality of raised and recessed portions are configured to be used in connection with an existing cam position sensor of the existing engine without changing the original radial distance of the cam sensor relative to the intermediate gear.

5. The overhead camshaft valvetrain system of claim 1, wherein the transmission system further comprises a plurality of guide members configured to route the at least one flexible transmitter around the existing engine.

6. The overhead camshaft valvetrain system of claim 5, wherein the plurality of guide members are positioned within an area defined between:

a first horizontal plane extending through a rotational axis of an uppermost of the at least one camshaft;

a second horizontal plane extending through a rotational axis of the crankshaft;

a first vertical plane extending through a rotational axis of an outermost of the at least one camshaft on a first lateral side of the existing engine; and a second vertical plane extending through a rotational axis of an outermost of the at least one camshaft on an second lateral side of the existing engine, the second lateral side being opposite the first lateral side.

7. The overhead camshaft valvetrain system of claim 6, wherein the cam-in-block engine block of the existing engine comprises a plurality of existing fastener holes and wherein at least one of the plurality of guide members is fastened directly to one of the plurality of existing fastener holes.

8. The overhead camshaft valvetrain system of claim 5, wherein the transmission system further comprises an intermediate gear and wherein the plurality of guide members are positioned within an area defined between:

a first horizontal plane extending through an uppermost portion of the cam-in-block engine block, a second horizontal plane extending through a rotational axis of the intermediate gear, a first vertical plane extending through an inboard-most side of a first existing fluid aperture of the cam-in-block engine block, the first existing fluid aperture being on a first lateral side of the existing engine, and a second vertical plane extending through an inboard-most side of a second existing fluid aperture of the cam-in-block engine block, the second existing fluid aperture being on a second lateral side of the existing engine, the second lateral side being opposite the first lateral side.

9. The overhead camshaft valvetrain system of claim 8, wherein the cam-in-block engine block of the existing engine comprises a plurality of existing fastener holes and wherein at least one of the plurality of guide members is fastened directly to one of the plurality of fastener holes.

10. The overhead camshaft valvetrain system of claim 5, wherein the plurality of guide members comprises at least one moveable guide member configured to move relative to the cam-in-block engine block.

11. The overhead camshaft valvetrain system of claim 10, wherein the moveable guide member is movable along a guide path to adjust tension in the flexible transmitter.

12. The overhead camshaft valvetrain system of claim 1, wherein the at least one motion converter comprises at least one of a bucket tappet, a finger follower, a rocker arm, and a pushrod.

13. The overhead camshaft valvetrain system of claim 1, wherein the at least one overhead camshaft of the first and second cylinder heads each comprises an intake camshaft and an exhaust camshaft.

14. The overhead camshaft valvetrain system of claim 1, further comprising a cover that comprises a rear portion comprising a plurality of apertures configured to receive fasteners for mounting the cover to the cam-in-block engine block, wherein the apertures are arranged to correspond to one or more existing fastener holes of the cam-in-block engine block.

15. An overhead cam cylinder head for use with an existing cam-in-block engine, the overhead cam cylinder head comprising:

an overhead valvetrain system comprising:

at least one overhead camshaft and a plurality of valves, the at least one overhead camshaft configured to actuate the plurality of valves; and a plurality of intake ports configured to be in fluid communication with an intake manifold of the existing cam-in-block engine and a plurality of piston bores of a cam-in-block engine block of the existing cam-in-block engine, wherein laterally extending vertical planes bisecting the plurality of intake ports are axially offset from longitudinal axes of the plurality of piston bores;

wherein the existing cam-in-block engine is an engine from the Chevrolet LS family, and wherein the overhead cam cylinder head can replace an existing cylinder head of the existing cam-in-block engine without modification to the cam-in-block engine block and the intake manifold.

16. The overhead cam cylinder head of claim 15, wherein the overhead cam cylinder head comprises a plurality of exhaust ports configured to be in fluid communication with an exhaust manifold of the existing cam-in-block engine, wherein the overhead cam cylinder head can replace the existing cylinder head of the existing cam-in-block engine without modification to an existing exhaust manifold.

17. An oil feed system for use with an existing oil feed system of an existing cam-in-block engine, the existing cam-in-block engine having at least a plurality of existing lifter passageways in fluid communication with a left oil galley, a plurality of existing lifter passageways in fluid communication with a right oil galley, and a bearing fluid passageway in fluid communication with the left oil galley, the oil feed system comprising:

an oil feed element positioned within at least one of the existing lifter passageways in fluid communication with at least one of the left oil galley and the right oil galley, the oil feed element configured to redirect oil from the galley into a cylinder head; and one or more passageway restrictor elements positioned within at least one of the existing lifter passageways in fluid communication with the left oil galley and at least one of the existing lifter passageways in fluid communication with the right oil galley, the passageway restrictor elements configured to inhibit flow of oil through the existing lifter passageways;

wherein the existing cam-in-block engine is an engine from the Chevrolet LS family.

18. The oil feed system of claim 17, wherein one or more passageway restrictor elements are positioned within all of the existing lifter passageways in fluid communication with the left oil galley.

19. The oil feed system of claim 17, wherein one or more galley restrictor elements are positioned within the right oil galley.

20. The oil feed system of claim 19, wherein one or more passageway restrictor elements are positioned within a front-most and rear-most existing lifter passageways in fluid communication with the right oil galley.

21. The overhead camshaft valvetrain system of claim 1, wherein the engine from the Chevrolet LS family is an LT engine.

22. The overhead cam cylinder head of claim 15, wherein the engine from the Chevrolet LS family is an LT engine.

23. The oil feed system of claim 17, wherein the engine from the Chevrolet LS family is an LT engine.

* * * * *